US005153110A

United States Patent [19]

Kawai et al.

[11] Patent Number: 5,153,110

[45] Date of Patent: Oct. 6, 1992

[54] METHOD OF FORMING COLORED IMAGES

[75] Inventors: Kiyoshi Kawai; Yoji Okazaki, both of Kanagawa, Japan

[73] Assignee: Fuji Photo Film Co., Ltd., Kanagawa, Japan

[21] Appl. No.: 832,630

[22] Filed: Feb. 12, 1992

Related U.S. Application Data

[63] Continuation of Ser. No. 376,051, Jul. 6, 1989, abandoned.

[30] Foreign Application Priority Data

Jul. 6, 1988 [JP] Japan ..... 63-168288

[51] Int. Cl.[5] ..... G03C 7/16

[52] U.S. Cl. ..... 430/375; 430/363; 430/377; 430/383; 430/550; 430/567

[58] Field of Search ..... 430/363, 375, 377, 383, 430/550, 567

[56] References Cited

FOREIGN PATENT DOCUMENTS 270430 7/1988 European Pat. Off. .

253166 11/1987 Japan .

18346 1/1988 Japan .

113534 5/1988 Japan .

*Primary Examiner*—Hoa Van Le

*Attorney, Agent, or Firm*—Sughrue, Mion, Zinn, Macpeak & Seas

[57] ABSTRACT

A method of forming colored images by exposing and then developing a silver halide color photographic photosensitive material which has a blue sensitive silver halide emulsion layer, a green sensitive silver halide emulsion layer and a red sensitive silver halide emulsion layer on a support. In the method, silver halide grains which have a silver bromide containing phase of which the silver bromide content is from 10 to 60 mol % localized at the surface or within the grains, and in which from 95 to 99.5 mol % (average value) of the grains as a whole in the emulsion layer consists of silver chloride, the remainder consisting of substantially silver iodide free silver bromide, are included in at least one of the green sensitive and red sensitive silver halide emulsion layers. The material is subjected to a scanning exposure with blue light, green light and red light.

11 Claims, No Drawings

METHOD OF FORMING COLORED IMAGES

This is a continuation of application Ser. No. 07/376,051 filed Jul. 6, 1989, now abandoned.

FIELD OF THE INVENTION

This invention concerns the formation of colored images by means of a scanning exposure on silver halide photographic photosensitive materials and, more precisely, it concerns a method of forming colored images in which a scanning exposure is made using a visible light source.

BACKGROUND OF THE INVENTION

The method of image formation using a so-called scanner system involves forming images using a scanning exposure. There are various types of recording apparatus in which use is made of scanner systems, and conventionally glow lamps, xenon lamps, mercury lamps, tungsten lamps and light emitting diodes have been used, for example, as the recording light sources in these scanner type recording devices. However, all these light sources have a low output, and there is a further disadvantage in that they have a short life expectancy. Scanners in which coherent laser light sources, for example, gas lasers such as neon-helium lasers, argon lasers and helium cadmium lasers, and semiconductor lasers, are used as light sources are used as a means of overcoming these problems.

Gas lasers have a high output but the equipment is bulky and expensive and there is a further disadvantage in that a modulator is required.

On the other hand, semiconductor lasers are small and cheap, modulation can be achieved easily, and they have a further advantage in that they have a longer life expectancy than gas lasers. However, the emission wavelengths of semiconductor lasers are, in the main, in the infrared region, and it is necessary to use sensitive materials which are photosensitive to the infrared region. However, infrared sensitive photosensitive materials have poor storage stability because of the poor stability of the infrared sensitizing dyes, they are difficult to manufacture, and they are also very poor in respect of their handling properties. Hence, a method of forming images by exposing a silver halide photosensitive material which has been spectrally sensitized in the visible region with spectrally sensitizing dyes which have good storage stability while retaining the advantages of the semiconductor laser is clearly desirable.

In one such method, second harmonics obtained by combining a laser with a wavelength conversion element consisting of a non-linear type optical material are used as light sources, as disclosed in JP-A-63-113534. (The term "JP-A" as used herein signifies an "unexamined published Japanese patent application".) However, the following major limitation inevitably arises when such light sources are used. Thus, the wavelengths of the lasers which can be used are limited and so the wavelengths of the second harmonics which can be obtained are also limited and it is not possible to select the wavelengths which are most desirable from the point of view of color reproduction.

The use of silver halide grains which have a high silver chloride content in the green sensitive layer and the red sensitive layer has been proposed, in JP-A-63-18345, as a means of resolving this problem.

Further, silver halide photosensitive material containing a high silver chloride-containing emulsion having a local phase of silver bromide has been known, as is described in EP-A-0273430 (The term "EP-A" as is herein signifies an unexamined published European patent application).

However, serious unforeseen problems arise with a normal printer exposure when scanning exposures are made using silver halide emulsions which have a high silver chloride content. Thus, the color on a single print obtained using a scanning exposure differs in the parts where the scanning exposure starts from that in the parts where the scanning exposure finishes. On investigating the cause of this effect in detail it was found that the speed and gradation of the silver halide emulsion change over a very short period of time (within 1 minute) after exposure. Moreover, it was found that this change is particularly pronounced when the exposure is short and the exposure brightness is high. Hence, this does not present a problem with the conventional method of exposure where the whole surface of each print is exposed at the same time, since in this case the color changes as a whole, but in the case of a scanning exposure where the different parts of the print are exposed at different times, differences in color arise according to the position on the print and the differences which do arise are readily seen.

Hence, sensitive materials which provide good color reproduction, making up for the disadvantages of exposing apparatus in which a laser is combined with a wavelength converting element (with which the wavelength selection range is narrow and it is difficult to select the preferred wavelength for color reproduction), and with which no change occurs in respect of speed or gradation after exposure will have to be developed for use as sensitive materials for scanning exposure purposes which have a good aging stability, being spectrally sensitized in the visible region with spectrally sensitizing dyes which have good stability with respect to the passage of time.

SUMMARY OF THE INVENTION

Hence, the aims of the invention are to provide silver halide color photographic photosensitive materials which can provide color prints with an even color, having good storage properties and color reproduction characteristics and exhibiting no change in speed or gradation after exposure when methods in which the colored image is formed by means of a scanning exposure with a light source in which a laser is used and, at the same time, and to provide a method of forming color images in which these materials are used.

The inventors have discovered that the aforementioned aims can be realized by means of a method of forming colored images by exposing and then developing and processing a silver halide color photographic photosensitive material which has a blue sensitive silver halide emulsion layer, a green sensitive silver halide emulsion layer and a red sensitive silver halide emulsion layer on a support, comprising: providing a silver halide color photographic photosensitive material which includes in at least one of the green sensitive and red sensitive silver halide emulsion layers, silver halide grains which have a silver bromide containing phase of which the silver bromide content is from 10 to 60 mol % localized at the surface or within the grains, and in which from 95 to 99.5 mol % (average value) of the grains as a whole in the emulsion layer consists of silver chloride, the remainder consisting of substantially silver iodide free silver bromide, and subjecting the material to a scanning exposure with blue light, green light and red light.

Preferably, the local silver bromide phase is present at the surface of the silver halide grains, and more preferably the local silver bromide phase is present in a discontinuous isolated form at the surface of the silver halide grains. It is also preferred that the local silver bromide phase is doped with metal ions other than silver ions. In one preferred embodiment of the invention, in the local silver bromide phase is doped with iridium ions.

Preferably, the scanning exposure is made using a laser as the scanning light source, and more preferably a scanning exposure is made using the second harmonics of semiconductor lasers. It is also preferred that second harmonics obtained using a semiconductor laser and the second harmonic conversion element are used for the scanning light source. Preferably organic non-linear optical materials are used for the second harmonic conversion elements. It is also preferred to employ compounds which can be represented by the general formula (VII) or (VIII) set forth later in the specification as organic non-linear optical materials. Preferably the wavelength conversion element has a guide structure or a fiber type structure.

In another preferred embodiment of the invention, the silver halide grains which are included in at least one of the green sensitive silver halide emulsion and red sensitive silver halide emulsion layers are silver halide grains in which there is a silver bromide containing layer at the corners of the grain surface, in which from 95 to 99.5 mol % of all the grains in the emulsion layer consist of silver chloride with a silver bromide content of from 0.5 to 5 mol %, and in which metal ions other than silver ions are included.

By following the present invention, it is possible to obtain color prints which have good color reproduction and with which the color is uniform across the parts at the start and finish of a scanning exposure by means of this invention.

DETAILED DESCRIPTION OF THE INVENTION

The silver halide emulsion which is used in at least one red sensitive layer or green sensitive layer of this invention is described below. The silver bromide local phase referred to as being present in the above mentioned silver halide grains signifies a part which has an essentially different silver bromide content from the other parts (substrate) within the grains.

Furthermore, the aforementioned 95 to 99.5 mol % (average value) silver chloride content relates to the silver halide in a single silver halide emulsion and signifies the value obtained as the average of the proportion of silver chloride in each grain.

In this invention, it is desirable that one layer should contain at least about 50 wt %, preferably at least about 70 wt %, and most desirably at least about 90 wt %, of a silver halide emulsion of the type described above. This wt % represents the proportion of the emulsion in cases where a plurality of silver halide emulsions are mixed together in a single emulsion layer and, of course, it includes those cases in which a single emulsion of this invention (100 wt %) is included in the emulsion layer.

The inclusion of metal ions (for example, ions of the metals or transition elements of group VIII or groups II of the periodic table, lead ions, thallium ions) or complex ions thereof in the localized phase or substrate of the silver halide grains of this invention is desirable in that it markedly increases the effect of the invention.

Thus combinations of iridium ions, rhodium ion and iron ions, for example, principally in the local phase, and metal ions selected from among osmium, iridium, rhodium, platinum, ruthenium, palladium, cobalt, nickel and iron, for example, or complex ions thereof principally in the substrate can be used. Different types and concentrations of metal ions can be used in the local phase and in the substrate, and a plurality of these metals may be used.

Furthermore, the ions of metals such as cadmium, zinc, lead, mercury, and thallium, for example, can also be used.

These metal ions will now be described in detail. The iridium ion containing compounds are salts or complex salts, preferably complex salts, of trivalent or tetravalent iridium. Preferred examples include iridium(III) chloride, iridium(III) bromide, iridium(IV) chloride and the halogen, amine and oxalato complex salts, such as sodium hexachloroiridium(III), potassium hexachloroiridium(IV), hexa-amine-iridium(IV) salts, trioxalatoiridium(III) salts and trioxalatoiridium(IV) salts, for example. The amount used is from about $5\times10^{-9}$ to about $1\times10^{-4}$ mol, and preferably from about $5\times10^{-8}$ to about $5\times10^{-6}$ mol, per mol of silver.

Platinum containing compounds include salts and complex salts of divalent and tetravalent platinum, and the complex salts are preferred. Examples include platinum(IV) chloride, potassium hexachloroplatinum(IV), tetrachloroplatinum(II) acid, tetrabromoplatinum(II) acid, sodium tetrakis(thiocyanato)platinum(IV) and hexaamineplatinum(IV) chloride. The amount used is from about $1\times10^{-8}$ to about $1\times10^{-5}$ mol per mol of silver.

The palladium ion containing compounds are normally salts or complex salts of divalent or tetravalent palladium, and the complex salts are especially desirable. For example, use can be made of sodium tetrachloropalladium(II), sodium hexachloropalladium (IV), potassium hexachloropalladium(IV), tetra-amine-palladium(II) chloride, and potassium tetracyanopalladium(II).

The nickel ion containing compounds which can be used include nickel chloride, nickel bromide, potassium tetrachloronickel(II), hexa-aminenickel(II) chloride and sodium tetracyanonickel(II).

The preferred compounds which contain rhodium ions are normally salts or complex salts of trivalent rhodium. Examples include potassium hexachlororhodium, sodium hexachlororhodium, and ammonium hexachlororhodium. The amount used is from about $10^{-8}$ to about $10^{-4}$ mol per mol Of silver.

The iron ion containing compounds are compounds which contain divalent or trivalent iron, preferably being iron salts or complex salts which are soluble in water in the concentration range in which they are used. The use of iron complex salts which are readily included in silver halide grains is especially desirable. Actual examples include ferrocyanides, ferricyanide, ferrous thiocyanate and ferric thiocyanate. The amount used is from about $5\times10^{-9}$ to about $1\times10^{-3}$ mol, and preferably from about $1\times10^{-8}$ to about $1\times10^{-4}$ mol per mol of silver.

The metal ions used in the invention may be included in the local phase of the silver halide grains and/or the other parts (substrate) of the grains by addition to a preparated solution prior to grain formation, during grain formation or during the process of physical ripening. For example, the metal ions may be added to the aqueous gelatin solution, to the aqueous halide solution, to the aqueous silver salt solution or to any other aqueous solution which is used in the formation of the silver halide grains.

Alternatively, the metal ions may be included beforehand in fine silver halide grains and these grains can be added to the prescribed silver halide emulsion and dissolved to introduce the metal ions into the emulsion. This method is particularly effective for introducing metal ions into a local silver bromide phase at the surface of the silver halide grains. The method by which the addition is made can be varied according to the intended location of the metal ions within the silver halide grains.

The halogen composition of the silver halide grains in this invention must be an essentially silver iodide free silver chlorobromide in which at least 95 mol %, and preferably at least 96 mol %, of all of the silver halide is silver chloride. The term "substantially silver iodide free" signifies that the silver iodide content is not more than 1.0 mol %. Essentially silver iodide free silver chlorobromides of which at least 98 mol % of all the silver halide from which the grains are formed consists of silver chloride are especially desirable silver halide grains in respect of the halide composition.

Moreover, the silver halide grains in this invention must have a local silver bromide phase which has a silver bromide content of at least 10 mol % but not more than 60 mol %. The arrangement of this local silver bromide phase is not fixed, depending on the intended purpose, and it may be within the silver halide grains, or at the surface or in the sub-surface of the silver halide grains, preferably at the surface of the silver halide grains. The local phase may have a layer like structure surrounding the silver halide grain internally or at the surface, or it may have a discontinuous, isolated structure. In a preferred example of the arrangement of the local silver bromide phase, a local phase of which the silver bromide content is at least 10 mol %, and preferably at least 20 mol %, is grown locally in an epitaxial manner on the surface of the silver halide grains (within the corners of the grains). The most desirable arrangement for the local silver bromide phase is in a discontinuous isolated from on the surface of the grains.

The silver bromide content of the local phase is preferably in excess of 20 mol %, but if the silver bromide content is too high desensitization may occur in cases where a pressure is applied to the photosensitive material, and pronounced variations in speed and gradation will inevitably arise as a result of variations in the composition of the processing baths, and the materials will clearly exhibit undesirable characteristics as photographic photosensitive materials. In consideration of these points, the silver bromide content of the local phase is preferably within the range from 20 to 60 mol %, and most desirably it is within the range from 30 to 50 mol %. Silver chloride is preferred for the other silver halide of the local phase. The silver bromide content of the local phase can be analyzed by using X-ray diffraction methods (for example, the method described in the Japanese Chemical Society publication entitled *New Experimental Chemistry Series* 6, *Structure Analysis*, published by Maruzen)(1977), or by using the XPS method (for example, the method described in *Surface Analysis—The Use of IMA, Auger Electrons and Photoelectrons*, published by Kodansha (1976)). The local phase preferably accounts for from about 0.1 to about 20%, and most desirably for from about 0.5 to about 7%, of all the silver in the silver halide grains of this invention.

The local silver bromide phase may be doped with metal ions other than silver ions. The metal ions other than silver ions are preferably iridium ions.

The interface between the local silver bromide phase and the other phase may be a distinct phase boundary, or there may be a short transition zone in which the halide composition changes gradually. Observation using an electron microscope and the method described in JP-A-01-026837 can be used to confirm the location of a local silver bromide phase.

Various methods can be used to form such a local silver bromide phase. For example, the local phase can be formed by reacting a soluble silver salt with a soluble halide using a single sided addition method or a simultaneous mixing method. Moreover, methods in which a silver halide which has already been formed is converted to a silver halide which has a lower solubility product, which is to say so-called conversion methods, can also be used to form a local phase. Alternatively, a local phase can be formed by adding fine silver bromide grains and recrystallizing this silver bromide on the surface of silver chloride grains.

These methods have been described, for example, in the specification of JP-A-01-026837.

The local phase is preferably precipitated along with at least about 50% of all the iridium which preferably is added during the preparation of the aforementioned silver halide grains.

Here, precipitation of the local phase together with the iridium ion signifies that the iridium compound is supplied at the same time as, immediately before, or immediately after, the addition of the silver and/or halide which is supplied for the formation of the local phase.

The silver halide grains in this invention may have (100) planes on the outer surface, (111) planes on the outer surface or they may have both of these types of planes on the outer surface, and the use of silver halide grains which have higher order surface planes is preferred.

The silver halide grains used in the invention may have a regular crystalline form (such as a cubic, tetradecahedral or octahedral form, or they may have an irregular form, such as a spherical or plate-like form, or they may have a composite form consisting of these crystalline forms. Use can also be made of mixtures of grains which have various crystalline forms, and the inclusion among the grains of at least about 50%, preferably at least about 70%, and most desirably at least about 90%, of grains which have the aforementioned regular crystalline forms is desirable.

The silver halide emulsions used in the invention may be emulsions in which tabular grains of which the average aspect ratio (length/thickness ratio) is at least 5, and preferably at least 8, account for at least 50% of the total projected area of the grains.

The size of the silver halide grains in this invention should be within the range normally used, but the use of grains of average grain size from 0.1 μm to 1.5 μm is preferred. The grains size distribution may be polydisperse of mono-disperse, but the use of mono-disperse emulsions is preferred. A grain size distribution which is represented as being mono-disperse preferably has a statistical variation coefficient (the value S/d obtained by dividing the standard deviation by the diameter d when the projected areas are approximately circular) of not more than about 20%, and most desirably of not more than about 15%.

Two or more types of tabular grain emulsions and mono-disperse emulsions of this type may be used in the form of mixtures. In cases where a mixture of emulsions is used it is desirable that at least one of the emulsions should have a variation coefficient as indicated above.

The so-called substrate part, being the part other than the local phase of the silver halide grains used in the invention, may have different phases for the interior part and the surface layer, or it may consist of a uniform phase.

Photographic emulsions which can be used in the invention can be prepared using the methods described, for example, by P. Glafkides in *Chemie et Physique Photographique* (published by Paul Montel, 1967), by G. F. Duffin in *Photographic Emulsion Chemistry* (published by the Focal Press, 1966) and by V. L. Zelikman et al. in *Making and Coating Photographic Emulsions* (published by the Focal Press, 1964).

Furthermore, silver halide solvents, for example, ammonia, potassium thiocyanate, ammonium thiocyanate, thioether compounds (as disclosed, for example, in U.S. Pat. Nos. 3,271,157, 3,574,628, 3,704,130, 4,297,439 and 4,276,374), thione compounds (as disclosed, for example, in JP-A-53-144319, JP-A-53-82408 and JP-A-55-77737) and amine compounds (as disclosed, for example, in JP-A-54-100717) can be used to control grain growth during the formation of the silver halide grains.

The silver halide grains in this invention are essentially of the surface latent image type and the surface must be chemically sensitized to a certain extent. Chemical sensitization can be carried out using sulfur sensitization methods in which active gelatin or compounds which contain sulfur which can react with silver (for example, thiosulfates, thioureas, mercapto compounds, rhodanines) are used; reduction sensitization methods in which reducing substances (for example, stannous salts, amines, hydrazine derivatives, formamidinesulfinic acid, silane compounds) are used; and precious metal sensitization methods in which metal compounds (for example, gold complex salts or complex salts of metals of group VIII of the periodic table such as platinum, iridium, palladium, rhodium and iron) are used, and these methods may be used individually but the use of combinations is preferred.

Details of these methods have been described in JP-A-62-215272 between line 18 of the lower left column and line 16 of the lower right column of page 12.

The addition of at least one compound which can be represented by any of the general formulae (I), (II) or (III) which are indicated below to a high silver chloride emulsion as used in this invention is very effective for preventing an increase in fog, especially when gold sensitizers are used. These compounds can be added during the grain formation, de-salting or chemical ripening processes, or immediately prior to coating, but they are preferably added during the grain formation, de-salting or chemical ripening processes prior to the addition of the gold sensitizing agent.

The compounds which have thiosulfonyl groups and which can be represented by the general formulae (I), (II) and (III) are described below.

$$Z-SO_2S-M$$ General Formula (I)

General Formula (II)

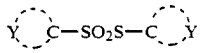

General Formula (III)

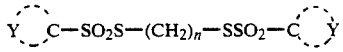

In these formulae, Z represents an alkyl group, an aryl group or a heterocyclic group, and these groups may be further substituted with substituent groups. Y represents a group of atoms which is required to form an aromatic ring or a heterocyclic ring, and these rings may be further substituted with substituent groups. M represents a metal atom or an organic cation. Moreover, n represents an integer of value from 2 to 10.

Examples of substituent groups which can be substituted on the aforementioned alkyl groups, aryl groups and aromatic or heterocyclic rings include lower alkyl groups (for example, methyl, ethyl), aryl groups (for example, phenyl), alkoxy groups which have from 1 to 8 carbon atoms, halogen atoms (for example, chlorine), nitro groups, amino groups and carboxyl groups.

The alkyl groups represented by Z preferably have from 1 to 18 carbon atoms, and the aryl groups and aromatic rings represented by Z and Y preferably have from 6 to 18 carbon atoms. The heterocyclic rings which can be represented by Z and Y may be, for example, thiazole rings, benzthiazole rings, imidazole rings, benzimidazole rings or oxazole rings.

The metal cations represented by M are preferably alkali metal cations (for example, sodium, potassium) and the preferred organic cations include ammonium ions and the guanidinium ion.

Actual examples of compounds which can be represented by general formulae (I), (II) and (III) are indicated below.

a

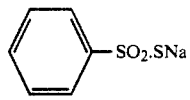

b

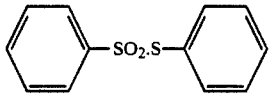

c

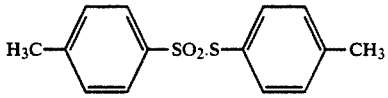

d

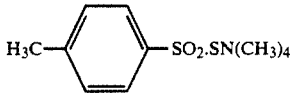

$H_3C.SO_2.SNa$ e

-continued f 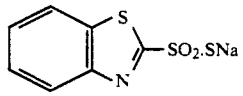

g 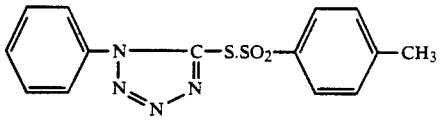

h 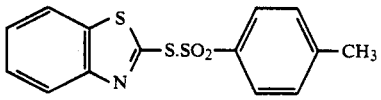

i 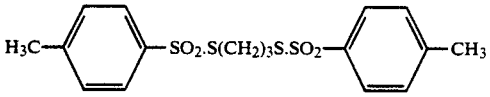

j 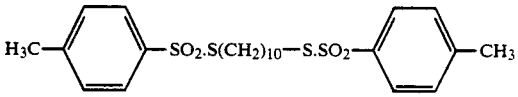

L-Cystein-disulfoxide k $H_5C_2.SO_2.S.K$ l $H_{17}C_8.SO_2.SNa$ m

The compounds represented by general formulae (I), (II) and (III) can be used conjointly with sulfinates, for example, with sulfites, alkylsulfinates, arylsulfinates and heterocyclic sulfinates.

Various compounds can be included in the photographic emulsions which are used in the invention with a view to preventing the occurrence of fogging during the manufacture, storage or photographic processing of the photosensitive material, or with a view to stabilizing photographic performance. Thus many compounds which are known as anti-fogging agents or stabilizers, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole and derivatives in which an N-methylureido group is substituted in the meta-position of the aforementioned phenyl group), mercaptopyrimidines; mercaptotriazines, etc.; thioketo compounds such as, for example, oxazolinethione; azaindenes, for example, triazaindenes, tetraazaindenes (especially 4-hydroxy-substituted (1,3,3a,7)tetraazaindene) and pentaazaindenes; benzenethiosulfonic acid, benzenesulfinic acid and benzenesulfonic acid amide can be added for this purpose.

The addition of mercaptoazoles which can be represented by the general formula (IV), (V) or (VI) indicated below from among these compounds to the coating liquid of the silver halide emulsion is preferred. The amount added is preferably from about $1\times10^{-5}$ to about $5\times10^{-2}$ mol, and most desirably from about $1\times10^{-4}$ to about $1\times10^{-2}$ mol, per mol of silver halide.

General Formula (IV)

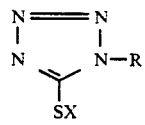

R in this formula represents an alkyl group, an alkenyl group or an aryl group. X represents a hydrogen atom, an alkali metal atom, an ammonium group or a precursor of these groups. The alkali metal atoms include sodium and potassium atoms, and the ammonium group may be, for example, a tetramethylammonium group or a trimethylbenzylammonium group. Furthermore, the precursor groups are groups which yield X being H or alkali metal atom under alkaline conditions and these groups include the acetyl group, the cyanoethyl group and the methanesulfonylethyl group, for example.

The alkyl groups and alkenyl groups among the aforementioned groups for R include both unsubstituted groups and substituted groups, and they also include alicyclic groups. Examples of substituent groups for the substituted alkyl groups include, for example, halogen atoms, nitro groups, cyano groups, hydroxyl groups, alkoxy groups, aryl groups, acylamino groups, alkoxycarbonylamino groups, ureido groups, amido groups, heterocyclic groups, acyl groups, sulfamoyl groups, sulfonamido groups, thioureido groups, carbamoyl groups, alkylthio groups, arylthio groups, heterocyclic thio groups and carboxylic acid groups and sulfonic acid groups and the salts of these groups.

The above-mentioned ureido groups, thioureido groups, sulfamoyl groups, carbamoyl groups, and amino groups include unsubstituted groups, N-alkyl substituted groups and N-aryl substituted groups. Examples of aryl groups include the phenyl group and the naphthyl group and these can be substituted with alkyl groups and the substituent groups for alkyl groups as described above.

General Formula (V)

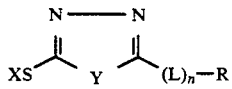

Y in this formula represents an oxygen atom or a sulfur atom.

L represents a divalent linking group and R represents a hydrogen atom, an alkyl group, an alkenyl group or an aryl group. The alkyl groups and alkenyl groups represented by R and X, are the same as those described in connection with general formula (IV).

Actual examples of the aforementioned divalent linking groups represented by L include

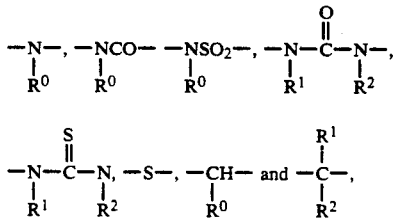

and combinations of these groups.

Moreover, n represents a value of 0 or 1 and $R^0$, $R^1$ and $R^2$ each represents a hydrogen atom, an alkyl group or an aralkyl group.

General Formula (VI)

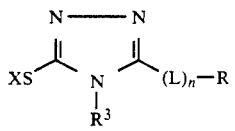

R and X in this formula have the same Significance as in general formula (IV) and L has the same significance as in general formula (V). $R^3$ has the same significance as R, and R and $R^3$ may be the same or different.

Actual examples of compounds which can be represented by the general formulae (IV), (V) and (VI) are indicated below, but the compounds are not limited to these examples.

(1)

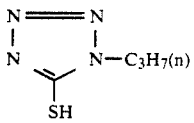

(2)

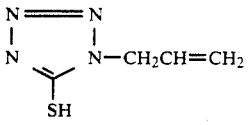

(3)

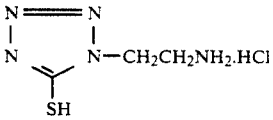

(4)

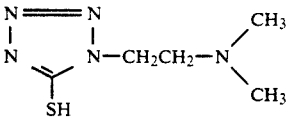

(5)

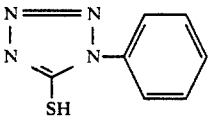

(6)

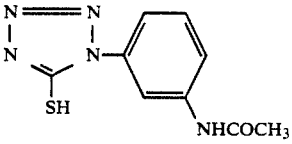

(7)

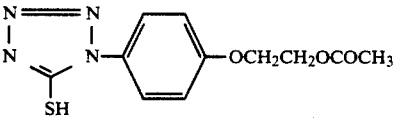

(8)

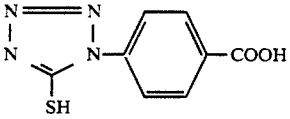

-continued (9)

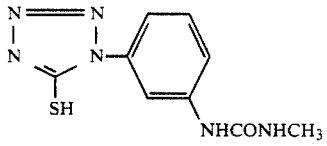

(10)

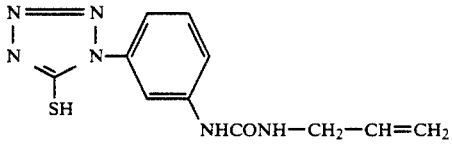

(11)

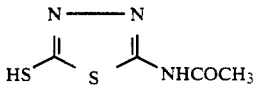

(12)

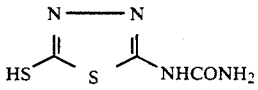

(13)

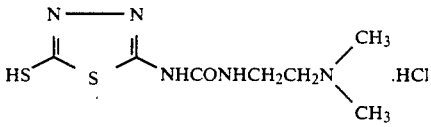

(14)

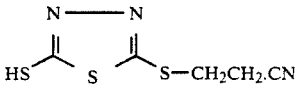

(15)

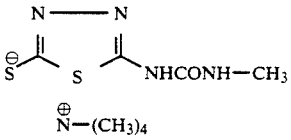

(16)

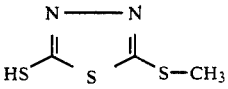

(17)

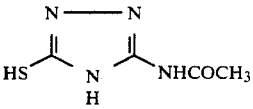

(18)

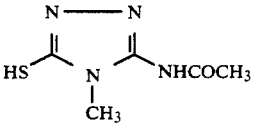

(19)

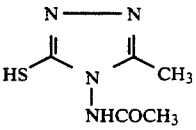

(20)

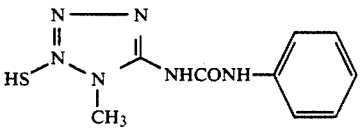

-continued

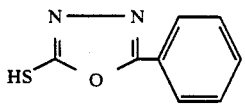

(21)

The sensitive materials of this invention have at least one blue sensitive layer, at least one green sensitive layer and at least one red sensitive layer, and sensitizing dyes are used with a view to providing spectral sensitivities in the prescribed wavelength region.

The methine dyes, such as the cyanine dyes and merocyanine dyes normally used for photographic purposes can be used for the spectrally sensitizing dyes. Actual examples of these dyes have been described in detail on pages 77 to 124 of JP-A-62-215272. The use of cyanine dyes which can be represented by the general formula (S) indicated below is especially desirable in this invention.

General Formula (S)

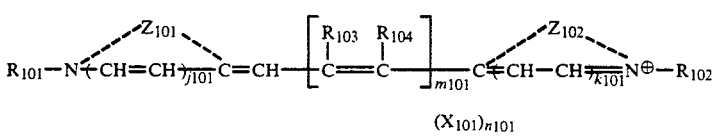

In this formula, $Z_{101}$ and $Z_{102}$ each represent a group of atoms which is required to form a heterocyclic nucleus.

Five or six membered heterocyclic nuclei which have an nitrogen atom and a sulfur atom, oxygen atom, selenium atom or tellurium atom as hetero-atoms (these rings may be joined to condensed rings and they may have substituent groups) are preferred as the heterocyclic nuclei.

Actual examples of the aforementioned heterocyclic nuclei include the thiazole nucleus, the benzothiazole nucleus, the naphthothiazole nucleus, the selenazole nucleus, the benzoselenazole nucleus, the naphthoselenazole nucleus, the oxazole nucleus, the benzoxazole nucleus, the naphthoxazole nucleus, the imidazole nucleus, the benzimidazole nucleus, the naphthimidazole nucleus, the 4-quinoline nucleus, the pyrroline nucleus, the pyridine nucleus, the tetrazole nucleus, the indolenine nucleus, the benzindolenine nucleus, the indole nucleus, the tellurazole nucleus, the benzotellurazole nucleus and the naphthotellurazole nucleus.

$R_{101}$ and $R_{102}$ each represents an alkyl group, an alkenyl group, an alkynyl group or an aralkyl group. These groups include those groups which have substituent groups. Thus, examples of alkyl groups include both unsubstituted and substituted alkyl groups, and these groups may have a linear chain, a branched chain or a cyclic form. The alkyl groups preferably have from 1 to 8 carbon atoms.

Furthermore, actual examples of substituent groups for the substituted alkyl groups include halogen atoms (for example, chlorine, bromine iodine), cyano groups, alkoxy groups, substituted or unsubstituted amino groups, carboxylic acid groups, sulfonic acid groups and hydroxyl groups, and the alkyl groups may be substituted with one or a plurality of these groups.

The vinylmethyl group is an actual example of an alkenyl group.

The benzyl group and the phenethyl group are actual examples of aralkyl groups.

Moreover, $m_{101}$ represents 0 or an integer of value 1, 2 or 3. In those cases where $m_{101}$ represents 1, $R_{103}$ represents a hydrogen atom, a lower alkyl group, an aralkyl group or an aryl group.

Substituted and unsubstituted phenyl groups are actual examples of the aforementioned aryl groups.

$R_{104}$ represents a hydrogen atom when $m_{101}$ is 1.

In cases where $m_{101}$ represents 2 or 3, $R_{103}$ represents a hydrogen atom and $R_{104}$ represents a hydrogen atom, a lower alkyl group or an aralkyl group, or it may be joined to $R_{102}$ to form a five or six membered ring. Furthermore, when $m_{101}$ represents 2 or 3, in those cases where $R_{104}$ represents a hydrogen atom $R_{103}$ may be joined to another $R_{103}$ in another unit, to form a hydrocarbyl ring or a heterocyclic ring. These rings are preferably five or six membered rings. Moreover, $j_{101}$ and $k_{101}$ represent 0 or 1, $X_{101}$ represents an acid anion and $n_{101}$ represents 0 or 1.

Among these compounds, those which have a reduction potential of −1.23 ($V_{vs}SCE$) or below are preferred, especially as red sensitive dyes, and among these compounds those which have a reduction potential of −1.27 or below are especially desirable. The preferred chemical structure is that of a benzothiadicarbocyanine dye in which a ring is formed by the joining together of two of the methine groups of the pentamethine linking group. Those in which electron donating groups, such as alkyl groups or alkoxy groups, are bonded to the benzene ring of the benzothiazole nucleus of the dyes are preferred.

The reduction potential can be measured using phase discrimination type second harmonic alternating current polarography. This is carried out using a dripping mercury electrode as the active electrode, a saturated calomel electrode for the reference electrode and platinum for the counter electrode.

Furthermore, the measurement of reduction potentials using phase discrimination type second harmonic alternating current polarography with platinum as the active electrode has been described in *The Journal of Imaging Science,* Vol. 30, page 27–35 (1986).

Typical examples of blue sensitive dyes which can be used in the invention are indicated below (SB-1 to SB-17).

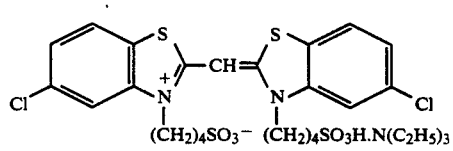

(SB-1)

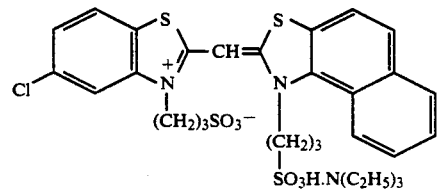

(SB-2)

-continued
(SB-3)
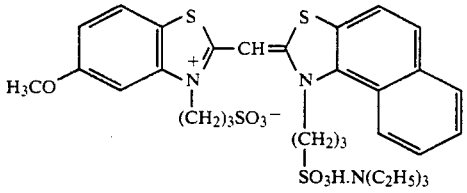
(SB-4)
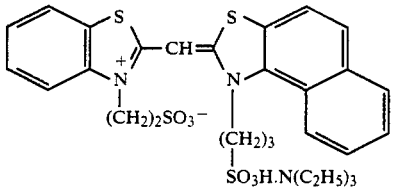
(SB-5)
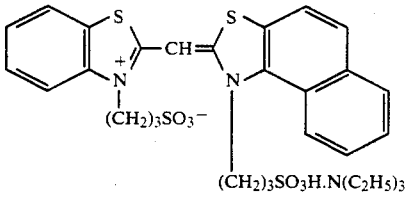
(SB-6)
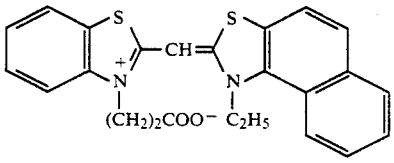
(SB-7)
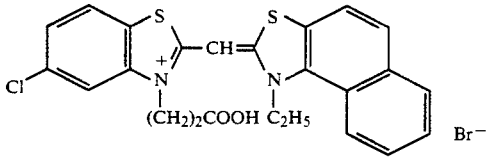
(SB-8)
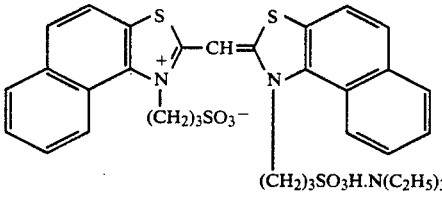
(SB-9)
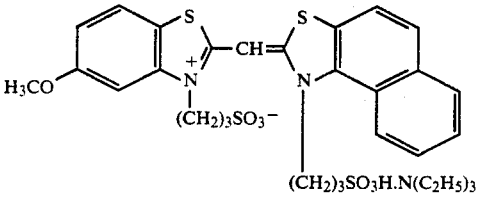
-continued
(SB-10)
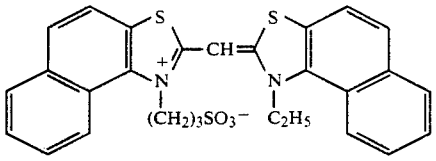
(SB-11)
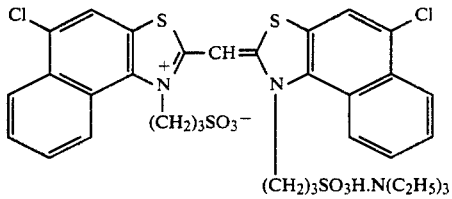
(SB-12)
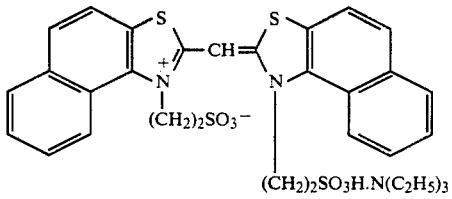
(SB-13)
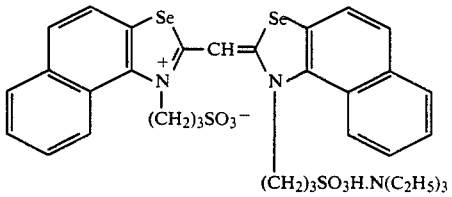
(SB-14)
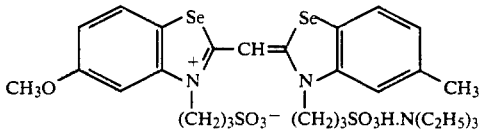
(SB-15)
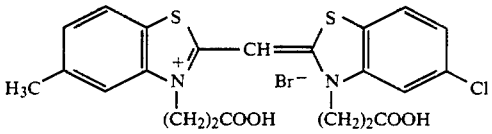
(SB-16)
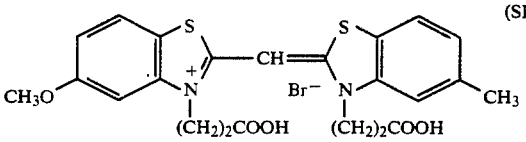
(SB-17)
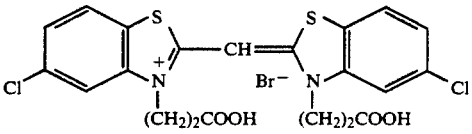
Typical examples of green sensitive dyes which can be used in the invention are indicated below (SG-1 to SG-19).

(SG-1)
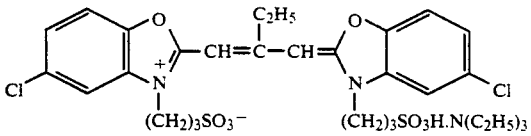
(SG-2)
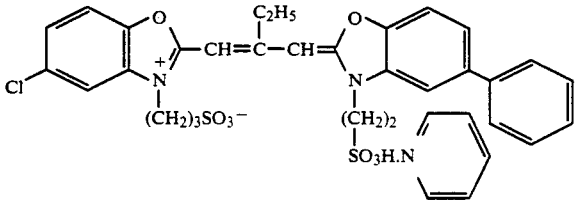
(SG-3)
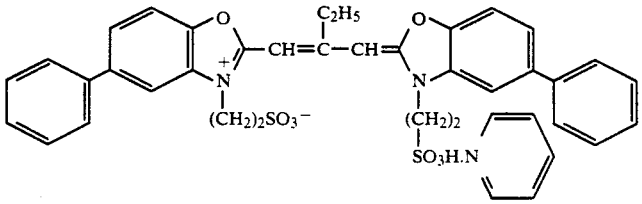
(SG-4)
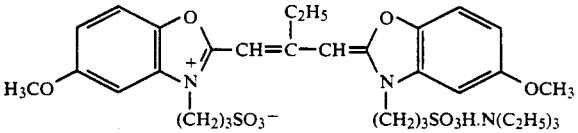
(SG-5)
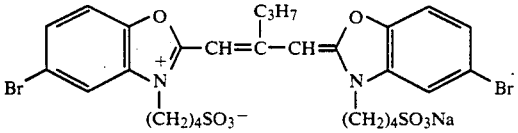
(SG-6)
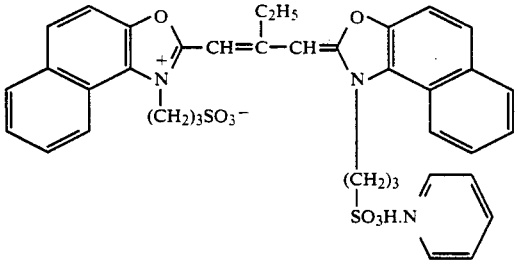
(SG-7)
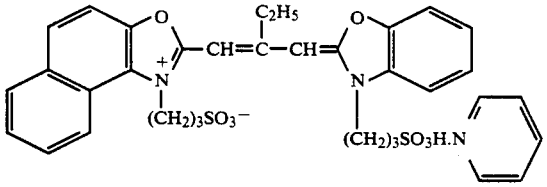
(SG-8)
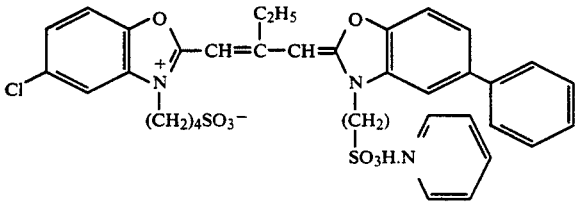

-continued
(SG-9)
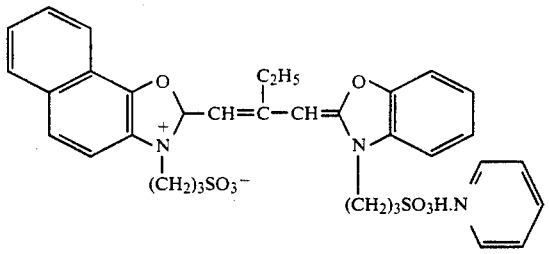
(SG-10)
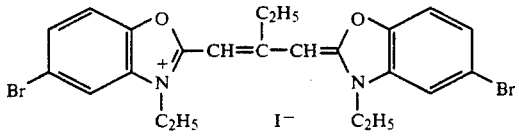
(SG-11)
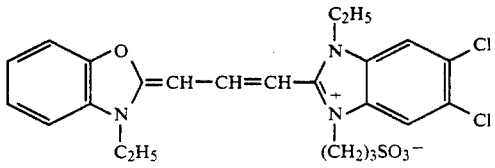
(SG-12)
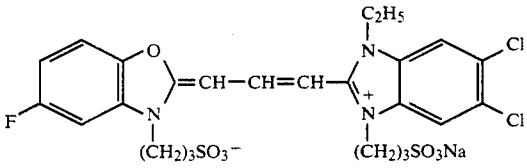
(SG-13)
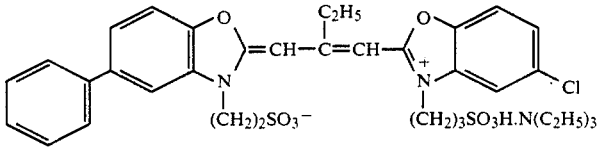
(SG-14)
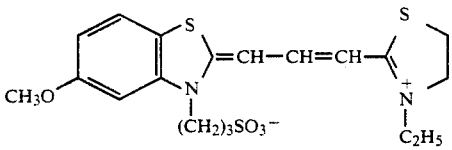
(SG-15)
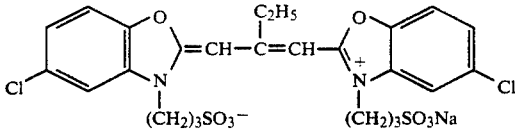
(SG-16)
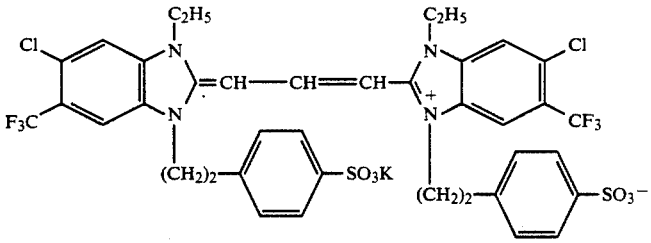
(SG-17)
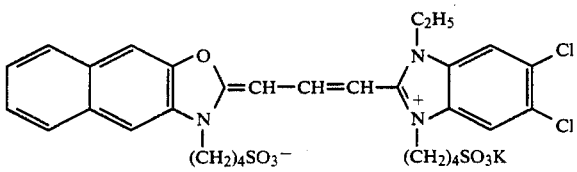

-continued
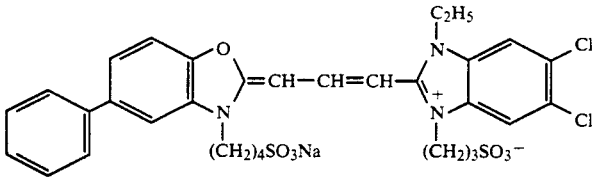
(SG-18)
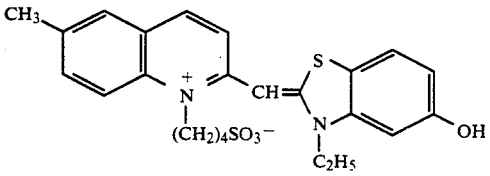
(SG-19)
Typical examples of red sensitive dyes which can be used in the present invention are indicated below (SR-1 to SR-16).
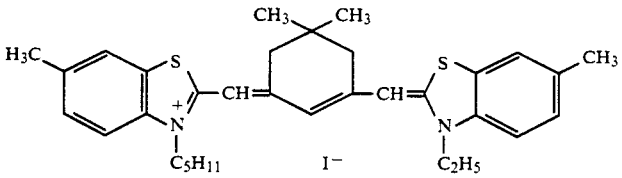
(SR-1)
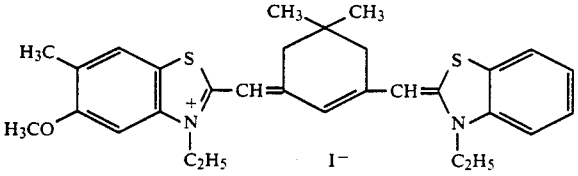
(SR-2)
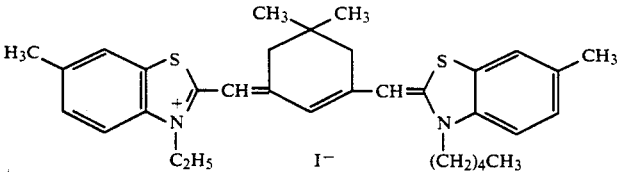
(SR-3)
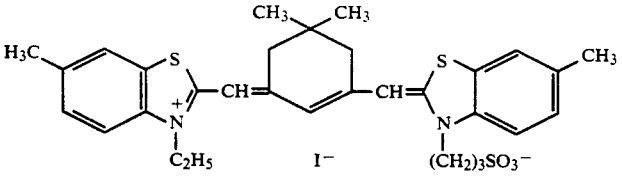
(SR-4)
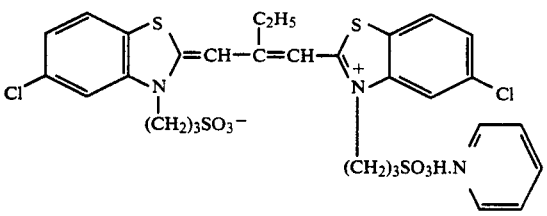
(SR-5)

-continued
(SR-6)
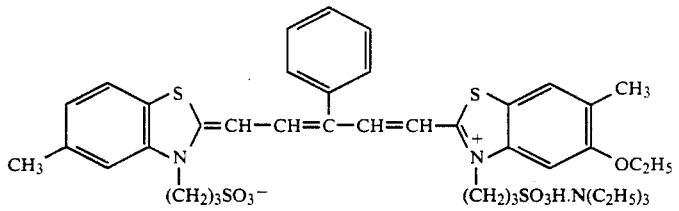
(SR-7)
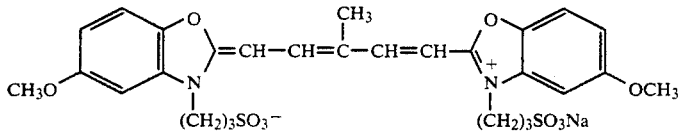
(SR-8)
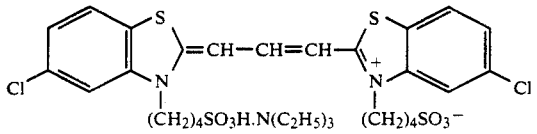
(SR-9)
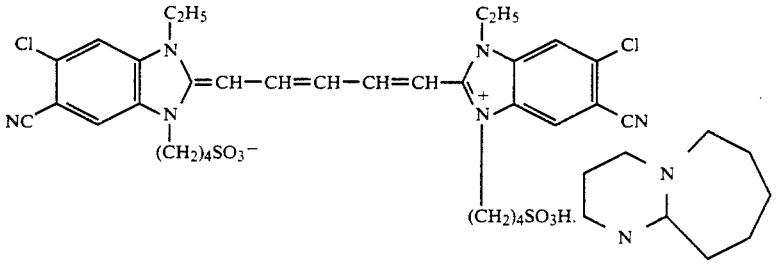
(SR-10)
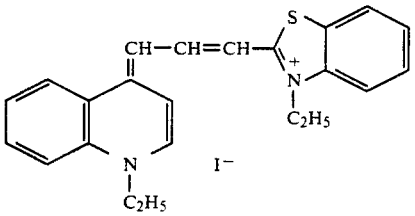
(SR-11)
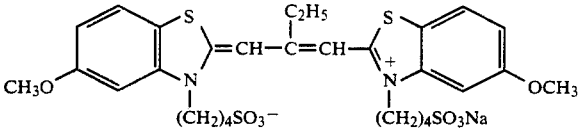
(SR-12)
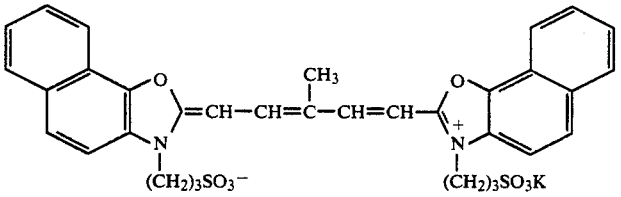
(SR-14)
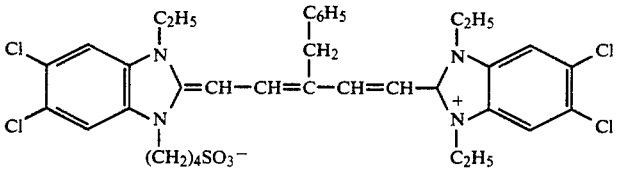

-continued (SR-15)

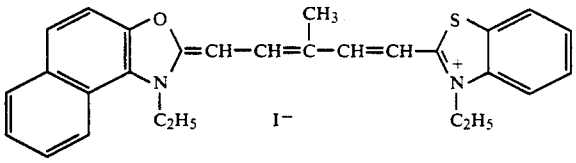

(SR-16)

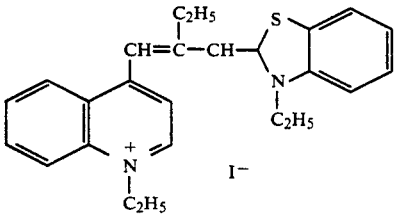

These sensitizing dyes can be added at any time before or during the formation of the grains of the silver halide emulsion, immediately after grain formation prior to washing, and before or during chemical sensitization until the emulsion is cooled and solidified immediately after chemical sensitization, or during the preparation of the coating liquid. Addition before washing the emulsion or before chemical sensitization is preferred.

The amount of sensitizing dye added varies over a wide range, depending on the particular case, but it is preferably from about $1.0\times10^{-6}$ to about $1.0\times10^{-2}$ mol, and most desirably from about $1.0\times10^{-5}$ to about $1.0\times10^{-3}$ mol, per mol of silver halide.

The addition of these spectrally sensitizing dyes during the preparation of the emulsions can be achieved using normal methods. That is to say, the dyes which are to be used can be dissolved in a suitable organic solvent (for example, methanol, ethanol or vinyl acetate) and added to the emulsion in the form of a solution of the appropriate concentration. Alternatively, the dyes which are to be used can be dispersed in an aqueous solution using surfactants, for example, or they can be dispersed in an aqueous gelatin solution of the appropriate concentration for addition to the emulsion in the form of an aqueous dispersion.

Yellow couplers, magenta couplers and cyan couplers which undergo a coupling reaction with the oxidized form of an aromatic amine based color developing agent to form yellow, magenta and cyan colorations are normally used in color photosensitive materials.

The acylacetamide derivatives, such as benzoylacetanilide and pivaloylacetanilide, are preferred from among the yellow couplers which can be used in the invention.

Among these couplers, those which can be represented by the general formulae (Y-1) and (Y-2) indicated below are preferred as the yellow couplers.

(Y-1)

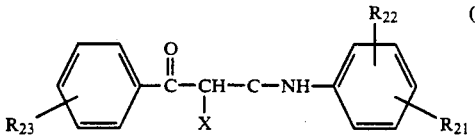

-continued (Y-2)

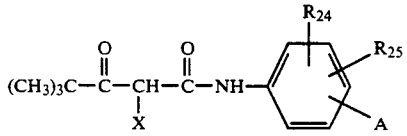

X in these formulae represents a hydrogen atom or a coupling leaving group. $R_{21}$ represents a group which has a total from 8 to 32 carbon atoms which renders the molecule resistant to diffusion, and $R_{22}$ represents a hydrogen atom, one or more halogen atoms, lower alkyl groups, lower alkoxy groups or groups which have a total of from 8 to 32 carbon atoms which render the molecule resistant to diffusion. $R_{23}$ represents a hydrogen atom or a substituent group. In those cases where there are two or more $R_{23}$ groups, these groups may be the same or different. $R_{24}$ represents a halogen atom, an alkoxy group, trifluoromethyl group, or an aryl group. $R_{25}$ represents a hydrogen atom, a halogen atom or an alkoxy group. A represents $-NHCOR_{26}$, $-NHSO_2-R_{26}$, $-SO_2NHR_{26}$, $-COOR_{26}$, or $$-SO_2NHR_{26},\ -COOR_{26},\ \text{or}\ -SO_2\underset{\underset{R_{27}}{|}}{N}-R_{26},$$

wherein $R_{26}$ and $R_{27}$ each represent an alkyl group, an aryl group or an acyl group.

Details of pivaloylacetanilide yellow couplers have been disclosed between line 15 of column 3 and line 39 of column 8 of the specification of U.S. Pat. No. 4,622,287,and between line 50 of column 14 and line 41 of column 19 of the specification of U.S. Pat. No. 4,623,616.

Details of benzoylacetanilide yellow couplers have been disclosed, for example, in U.S. Pat. Nos. 3,408,194, 3,933,501, 4,046,575, 4,133,958 and 4,401,752.

Actual examples of pivaloylacetanilide yellow couplers include the illustrative compounds (Y-1) to (Y-39) disclosed in columns 37 to 54 of the specification of U.S. Pat. No. 4,622,287, and from among these illustrative compounds (Y-1), (Y-4), (Y-6), (Y-7), (Y-15), (Y-21), (Y-22), (Y-23), (Y-26), (Y-35), (Y-36), (Y-37), (Y-38), and (Y-39), for example, are preferred.

Further examples include the illustrative compounds (Y-1) to (Y-33) disclosed in columns 19 to 24 of the specification of U.S. Pat. No. 4,623,616 mentioned earlier, and from among these compounds (Y-2), (Y-7), (Y-8), (Y-12), (Y-20), (Y-21), (Y-23) and (Y-29), for example, are preferred.

Further preferred yellow couplers include typical example (34) disclosed in column 6 of the specification of U.S. Pat. No. 3,408,194, illustrative compounds (16) and (19) disclosed in column 8 of the specification of U.S. Pat. No. 3,933,501, illustrative compound (9) disclosed in columns 7 and 8 of the specification of U.S. Pat. No. 4,046,575, illustrative compound (1) disclosed in columns 5 and 6 of the specification of U.S. Pat. No. 4,133,958, illustrative compound 1 disclosed in column 5 of the specification of U.S. Pat. No. 4,401,752, and the compounds a) to h) indicated below.

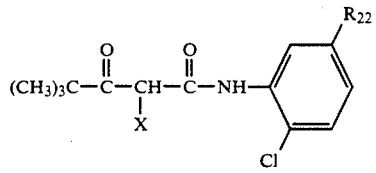

| Compound | $R_{22}$ | X |
|---|---|---|
| a | $-COOCH(CH_3)COOC_{12}H_{25}$ | 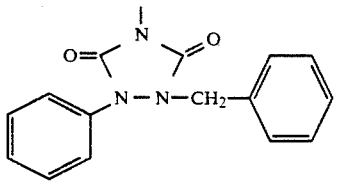 |
| b | $-COOCH(C_4H_9)COOC_{12}H_{25}$ | As above |
| c | 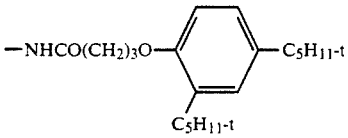 | 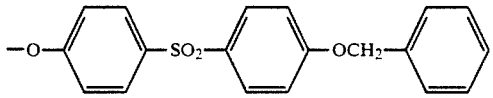 |
| d | As above | 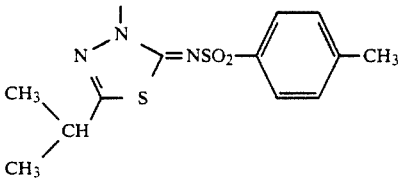 |
| e | As above | 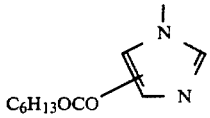 |
| f | $-NHSO_2C_{12}H_{25}$ | 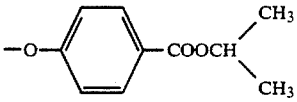 |
| g | $-NHSO_2C_{16}H_{33}$ | 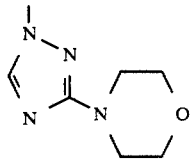 |

-continued

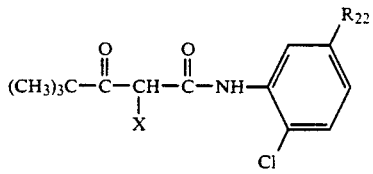

| Compound | $R_{22}$ | X |
|---|---|---|
| h | $-NHC(O)CH(CH_3)CH_2SO_2C_{12}H_{25}$ | 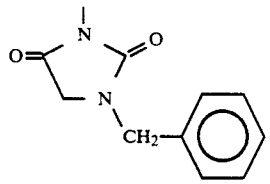 |

Those of the above-mentioned couplers in which a nitrogen atom forms the leaving groups are especially desirable.

Oil protected type indazole based, cyanoacetyl based or, preferably, 5-pyrazolone based or pyrazoloazole, for example, pyrazolotriazole, based couplers are examples of magenta couplers which can be used in this invention. 5-pyrazolone based couplers substituted in the 3-position with an arylamino group or an acylamino group are preferred from the points of view of the hue of the colored dye which is formed and the color density, and typical examples have been disclosed, for example, in U.S. Pat. Nos. 2,311,082, 2,343,703, 2,600,788, 2,908,573, 3,062,653, 3,152,896 and 3,936,015. The nitrogen atom leaving groups disclosed in U.S. Pat. No. 4,310,619, or the arylthio groups disclosed in U.S. Pat. No. 4,351,897, are preferred as two-equivalent 5-pyrazolone based coupler leaving groups. Furthermore, the 5-pyrazoline based couplers which have ballast groups disclosed in European Patent 73,636 provide high color densities.

The pyrazolobenzimidazoles disclosed in U.S. Pat. No. 2,369,879, and preferably the pyrazolo[5,1-c][1,2,4]triazoles disclosed in U.S. Pat. No. 3,725,067, the pyrazolotetrazoles disclosed in *Research Disclosure* 24220 (June 1984) and the pyrazolotetrazoles disclosed in *Research Disclosure* 24230 (June 1984) can be used as pyrazoloazole based couplers. The couplers described above can also take the form of polymerized couplers.

The magenta couplers can be represented, in practical terms, by the general formulae (M-1), (M-2) and (M-3) indicated below.

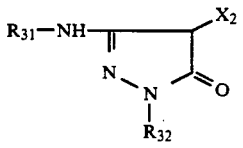

(M-1)

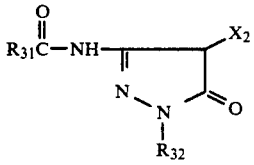

(M-2)

-continued

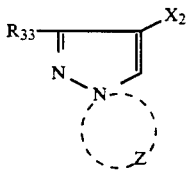

(M-3)

Here, $R_{31}$ represents a group which has a total of from 8 to 32 carbon atoms which renders the molecule fast to diffusion, and $R_{32}$ represents a phenyl group or a substituted phenyl group. $R_{33}$ represents a hydrogen atom or a substituent group. Z represents a group of non-metal atoms which is required to form a five membered azole ring which has from 2 to 4 nitrogen atoms, and the azole ring may have substituent groups (including condensed rings).

$X_2$ represents a hydrogen atom or a leaving group.

Details of the substituent groups represented by $R_{33}$ and the substituent groups for the azole ring have been described, for example, between line 41 of column 2 and line 27 of column 8 of the specification of U.S. Pat. No. 4,540,654.

The imidazo[1,2-b]pyrazoles disclosed in U.S. Pat. No. 4,500,630 are preferred, and the pyrazolo[1,5-b][1,2,4]triazoles disclosed in U.S. Pat. No. 4,540,654 are especially desirable from among the pyrazolone based couplers from the point of view of the small subsidiary yellow absorption and the light fastness of the colored dye which is formed.

Furthermore, the use of the pyrazolotriazole couplers which have a branched alkyl groups bonded to the 2-, 3- or 6-position of the pyrazolotriazole ring as disclosed in JP-A-61-65245, the pyrazoloazole couplers which contain a sulfonamido group within the molecule as disclosed in JP-A-61-65246, the pyrazoloazole couplers which have an alkoxyphenylsulfonamido ballast group as disclosed in JP-A-61-147254, and the pyrazolotriazole couplers which have an alkoxy group or an aryloxy group in the 6-position as disclosed in European Patent (Laid open) No. 226,849 is also desirable.

Actual examples of these couplers are indicated below.

| Compound | $R_{33}$ | $R_{34}$ | $X_2$ |
|---|---|---|---|
| | | 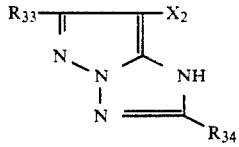 | |
| M-1 | $CH_3$— | 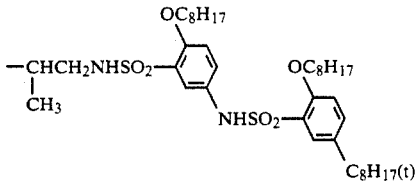 | Cl |
| M-2 | As above | 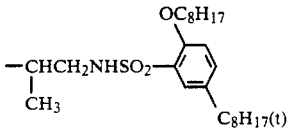 | As above |
| M-3 | As above | 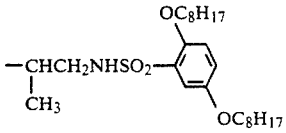 | 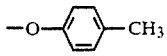 |
| M-4 | 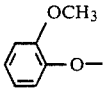 | 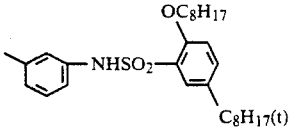 | 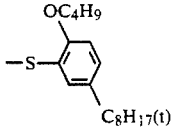 |
| M-5 | $CH_3$— | 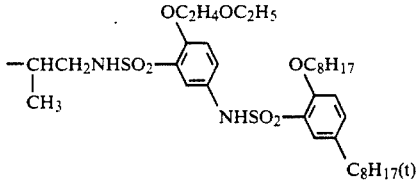 | Cl |
| M-6 | As above | 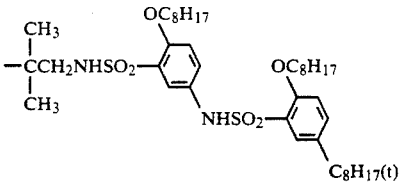 | As above |
| M-7 | 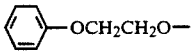 | 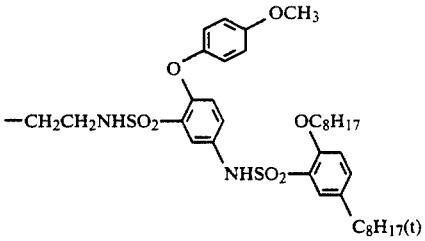 | 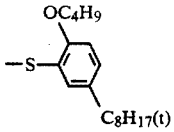 |
| M-8 | $CH_3CH_2O$— | As above | As above |
| M-9 | 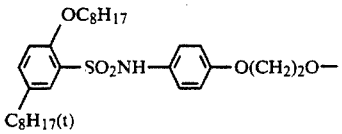 | 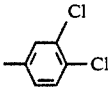 | 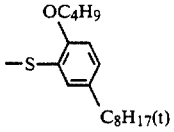 |

-continued

| Compound | $R_{33}$ | $R_{34}$ | $X_2$ |
|---|---|---|---|
| M-10 | 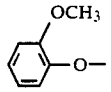 | 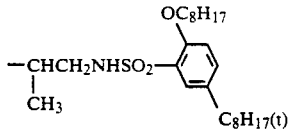 | Cl |
| | 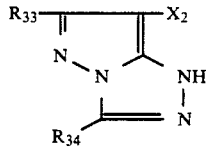 | | |
| M-11 | $CH_3$— | 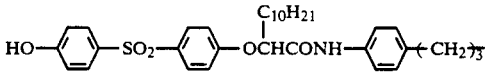 | Cl |
| M-12 | As above | 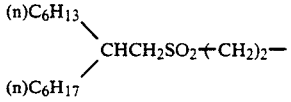 | As above |
| M-13 | 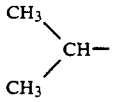 | 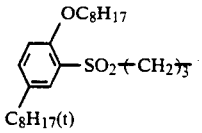 | As above |
| M-14 | 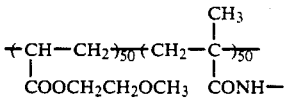 | 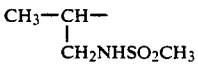 | As above |
| M-15 | 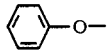 | 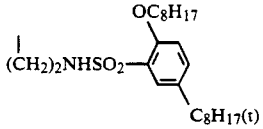 | Cl |
| M-16 | 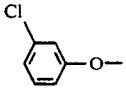 | 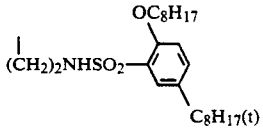 | 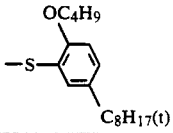 |

Phenol based cyan couplers and naphthol based cyan couplers are the most typical of the cyan couplers. Phenol based couplers include those which have a acylamino groups in the 2-position and an alkyl group in the 5-position of the phenol nucleus (including polymerized couplers) as disclosed, for example, in U.S. Pat. Nos. 2,369,929, 4,518,687, 4,511,647 and 3,772,002, and typical examples of these include the couplers of Example 2 disclosed in Canadian Patent 625,822, compound (1) disclosed in U.S. Pat. No. 3,772,002, compounds (I-4) and (I-5) disclosed in U.S. Pat. No. 4,564,590, compounds (1), (2), (3) and (24) disclosed in JP-A-61-39045, and compound (C-2) disclosed in JP-A-62-70846.

Phenol based cyan couplers also include the 2,5-diacylaminophenol based couplers disclosed in U.S. Pat. Nos. 2,772,162, 2,895,826, 4,334,011 and 4,500,653, and in JP-A-59-164555, and typical examples include compound (V) disclosed in U.S. Pat. No. 2,895,826, compound (17) disclosed in U.S. Pat. No. 4,557,999, compounds (2) and (12) disclosed in U.S. Pat. No. 4,565,777, compound (4) disclosed in U.S. Pat. No. 4,124,396, and compound (I-19) disclosed in U.S. Pat. No. 4,613,564.

Use can also be made of the phenol based cyan couplers in which a nitrogen containing heterocyclic ring is condensed with the phenol nucleus disclosed in U.S. Pat. Nos. 4,372,173, 4,564,586 and 4,430,423, JP-A-61-390441 and JP-A-61-100222, and typical examples include couplers (1) and (3) disclosed in U.S. Pat. No. 4,327,173, compounds (3) and (16) disclosed in U.S. Pat. No. 4,564,586, compounds (1) and (3) disclosed in U.S. Pat. No. 4,430,423, and the compounds indicated below.

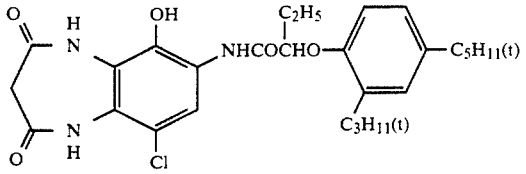
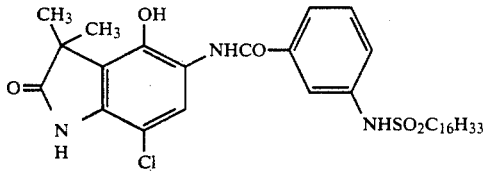
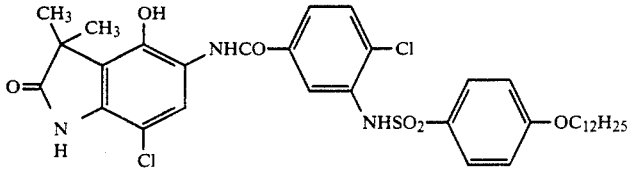
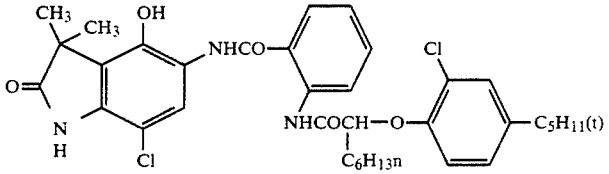
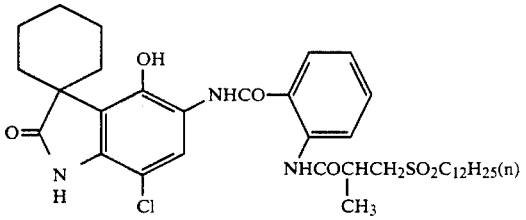
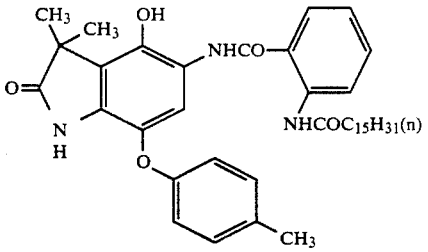
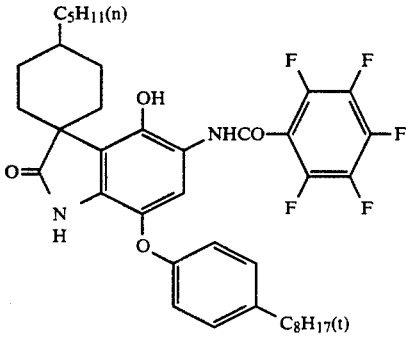

-continued

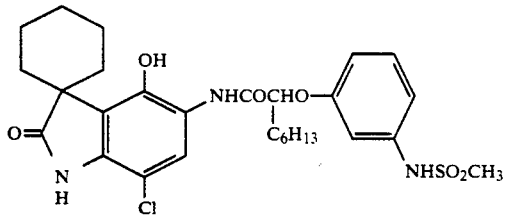

The ureido based couplers disclosed, for example, in U.S. Pat. Nos. 4,333,999, 4,451,559, 4,444,872, 4,427,767 and 4,579,813, and European Patent (EP) 067,689Bl can also be used as phenol based cyan couplers, and typical examples include coupler (7) disclosed in U.S. Pat. No. 4,333,999, coupler (1) disclosed in U.S. Pat. No. 4,451,559, coupler (14) disclosed in U.S. Pat. No. 4,444,872, coupler (3) disclosed in U.S. Pat. No. 4,427,767, couplers (6) and (24) disclosed in U.S. Pat. No. 4,609,619, couplers (1) and (11) disclosed in U.S. Pat. No. 4,579,813, couplers (45) and (50) disclosed in European Patent (EP) 067,689Bl, and coupler (3) disclosed in JP-A-61-42658.

Naphthol based cyan couplers include those which have an N-alkyl-N-arylcarbamoyl group in the 2-position of the naphthol nucleus (for example, those disclosed in U.S. Pat. No. 2,313,586), those which have an alkylcarbamoyl group in the 2-position (for example, those disclosed in U.S. Pat. Nos. 2,474,293 and 4,282,312), those which have an arylcarbamoyl group in the 2-position (for example, those disclosed in JP-B-50-14523), those which have a carbonamido group or a sulfonamido group in the 5-position (for example, those disclosed in JP-A-60-237448, JP-A-61-145557 and JP-A-61-153640), those which have an aryloxy leaving group (for example, those disclosed in U.S. Pat. No. 3,476,563), those which have a substituted alkoxy leaving group (for example, those disclosed in U.S. Pat. No. 4,296,199) and those which have a glycolic acid leaving group (for example, those disclosed in JP-B-60-39217). (The term "JP-B" as used herein signifies an "examined Japanese patent publication".)

The yellow, magenta and cyan couplers can be included in an emulsion layer by dispersion along with at least one type of high boiling point organic solvent. The preferred high boiling point organic solvents for this purpose can be represented by the formulae (A) to (E) indicated below.

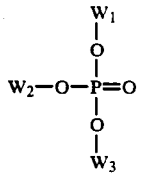

Formula (A)

$W_1$—COO—$W_2$ Formula (B)

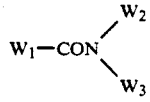

Formula (C)

-continued

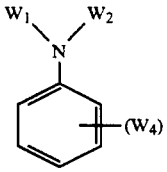

(D) Formula (D)

$W_1$—O—$W_2$ Formula (E)

In the above formulae (A) to (E), $W_1$, $W_2$ and $W_3$ each represent a substituted or unsubstituted alkyl group, cycloalkyl group, alkenyl group, aryl group or heterocyclic group, $W_4$ represents $W_1$, —$OW_1$ or —S—$W_1$, and n is an integer of value from 1 to 5, and when n has a different. Moreover, $W_1$ and $W_2$ in general formula (E) may form a condensed ring.

Furthermore, the yellow, magenta and cyan couplers can be loaded onto a loadable latex polymer with or without the use of a high boiling point organic solvent (for example, those disclosed in U.S. Pat. No. 4,203,716), or they can be dissolved in a polymer which is insoluble in water and soluble in organic solvents and emulsified and dispersed in a hydrophilic colloid solution.

The use of the homopolymers or copolymers disclosed on pages 12 to 30 of the specification of World Patent W088/00723 is preferred, and the use of acrylamide based polymers is especially desirable from the point of view of the stability of the colored image.

Photosensitive materials prepared using this present invention may contain hydroquinone derivatives, aminophenol derivatives, gallic acid derivatives and ascorbic acid derivatives, for example, as anti-color fogging agents.

Various anti-color fading agents can also be used in photosensitive materials of this invention. That is to say, hydroquinones, 6-hydroxychromans, 5-hydroxycoumarans, spyrochromans, p-alkoxyphenols, hindered phenols based on bisphenol, gallic acid derivatives, methylenedioxybenzenes, aminophenols, hindered amines, and ethers or ester derivatives in which the phenolic hydroxyl groups of these compounds have been silylated or alkylated are typical examples of organic anti-color fading agents which can be used for the cyan, magenta and/or yellow images. Furthermore, metal complexes typified by the (bis-salicylaldoxymato)-nickel complex and the (bis-N,N-dialkyldithiocarbamato)-nickel complex can also be used for this purpose.

Actual examples of organic anti-color fading agents have been disclosed in the patents indicated below.

Thus, hydroquinones have been disclosed, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921 and U.S. Pat. Nos. 2,710,801 and 2,816,028, 6-hydroxychromans, 5-hydroxycoumarans and spirochromans have been disclosed, for example, in U.S. Pat. Nos. 3,432,300, 3,573,050, 3,574,627, 3,698,909 and 3,764,337, and JP-A-52-152225, spiroindanes have been disclosed in U.S. Pat. No. 4,360,589, p-alkoxyphenols have been disclosed, for example, in U.S. Pat. No. 2,735,765, British Patent 2,066,975, JP-A-59-10539 and JP-B-57-19765, hindered phenols have been disclosed, for example, in U.S. Pat. No. 3,700,455, JP-A-52-72224, U.S. Pat. No. 4,228,235 and JP-B-52-6623, gallic acid derivatives, methylenedioxybenzenes and aminophenols have been disclosed, respectively, for example, in U.S. Pat. Nos. 3,457,079 and 4,332,886 and JP-B-56-21144, hindered amines have been disclosed, for example, in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344, ether and ester derivatives of phenolic hydroxyl groups have been disclosed, for example, in U.S. Pat. Nos. 4,155,765, 4,174,220, 4,254,216 and 4,264,720, JP-A-54-145530, JP-A-55-6321, JP-A-58-105147, JP-A-59-10539, JP-B-57-37856, U.S. Pat. No. 4,279,990, and JP-B-53-3263, and metal complexes have been disclosed, for example, in U.S. Pat. Nos. 4,050,938 and 4,241,155, and British Patent 2,027,731(A). The intended purpose can usually be realized by adding these compounds to the photosensitive layer by co-emulsification with coupler in an amount ranging from about 5 to about 100 wt % with respect to the corresponding coupler. The incorporation of ultraviolet absorbers into the layers on either side adjacent to the cyan color forming layer is more effective for preventing degradation of the cyan dye image by heat and, more especially, by light.

The spiroindanes and hindered amines are especially desirable from among the anti-color fading agents described above.

The use of compounds such as those described below together with the couplers, and especially the pyrazoloazole couplers, described earlier is desirable in this present invention.

That is to say, the use of compounds (F) which bond chemically with aromatic amine based developing agents which are left behind after the color development process and produce compounds which are chemically inactive and essentially colorless, and/or compounds (G) which bond chemically with the oxidized forms of aromatic amine based color developing agents which are left behind after the color development process and form compounds which are chemically inactive and essentially colorless is desirable for preventing the occurrence during storage after processing of staining or other side effects due to colored dye formation resulting from a reaction between the couplers and any color developing agent or oxidized form of the color developing agent which is left behind in the film.

Compounds which react with p-anisidine with a second order reaction rate constant $k_2$ (in trioctyl phosphate at 80° C.) within the range from 1.0 to $1\times10^{-5}$ liter/mol.sec are preferred for the (F) compounds. The second order reaction rate constant is obtained according to the method disclosed in JP-A-63-158545.

If the second order reaction rate constant $k_2$ is greater than the range specified above the compound itself is unstable and will react with gelatin or water and decompose. On the other hand, if the second order reaction rate constant $k_2$ is below the range specified above the reaction of the compound with any residual aromatic amine based developing agent is slow and consequently it is not possible to prevent the occurrence of certain side effects of the residual aromatic amine based developing agent.

The preferred (F) compounds of this type can be represented by the general formula (FI) or the general formula (FII) indicated below.

General Formula (FI)

$$R_1\text{-}(A)_n\text{-}X \qquad \text{(FI)}$$

$$R_2\text{-}\underset{\underset{B}{|}}{C}=Y \qquad \text{(FII)}$$

In these formulae, $R_1$ and $R_2$ each represent an aliphatic group, an aromatic group or a heterocyclic group. Moreover n represents 1 or 0, A represents a group forming a chemical bond by a reaction with aromatic amine developing agent and X represents a group released by a reaction with aromatic amine developing agent. B represents a hydrogen atom, an aliphatic group, an aromatic group, a heterocyclic group, an acyl group or a sulfonyl group, and Y represents a group which promotes the addition of an aromatic amine based developing agent to the compound of general formula (FII). Here, $R_1$ and X, and Y and $R_2$ or B may be joined together to form a cyclic structure.

Substitution reactions and addition reactions are typical of the systems by which chemical bonding with a residual aromatic amine based developing agent may occur.

Actual examples of compounds which can be represented by the general formulae (FI) and (FII) have been disclosed, for example, in JP-A-62-283338, 63-158545, EP 0298321 and EP 0277589.

Ultraviolet absorbers may be included in the hydrophilic colloid layers in photosensitive materials which have been prepared using this present invention. For example, use can be made of benzotriazole compounds which are substituted on the aryl group (for example, those disclosed in U.S. Pat. No. 3,533,794), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,375), butadiene compounds (for example, those disclosed in U.S. Pat. No. 4,045,229), or benzoxydol compounds (for example, those disclosed in U.S. Pat. No. 3,700,455). Couplers which have ultraviolet absorbing properties (for example, α-naphthol based cyan dye forming couplers) or ultraviolet absorbing polymers, for example, can also be used for this purpose. These ultraviolet absorbers may be mordanted in a specified layer.

Water soluble dyes can be included in the hydrophilic colloid layers in the photosensitive materials made using this invention as filter dyes, and anti-irradiation dyes or for various other purposes. Dyes of this type include oxonol dyes, hemioxonal dyes, styryl dyes, merocyanine dyes, cyanine dyes and azo dyes. The oxonol dyes, hemioxonal dyes and merocyanine dyes are useful form among these dyes.

The use of gelatin is convenient as a binding agent or protective colloid which can be used in the emulsion layers of photosensitive materials of this invention, but other hydrophilic colloids, either alone or in conjunction with gelatin, can be used for this purpose.

The gelatin used in the invention may be a lime treated gelatin or an acid treated gelatin. Details of methods for the preparation of gelatins have been described by Arthur Weise in *The Macromolecular Chemistry of Gelatin* (published by Academic Press, 1964).

Transparent films, such as cellulose nitrate films and polyethyleneterephthalate films, and reflective supports which are normally used for photosensitive materials can be used as the supports which are used in this invention. The use of reflective supports is more desirable for the purpose of this invention.

The term "reflective support" as used in this invention signifies a support which is highly reflective and which brightens the dye image which is formed in the silver halide emulsion layer, and reflective supports of this type include those in which a support is covered with a hydrophobic resin which contains as a dispersion a light reflecting substance such as titanium oxide, zinc oxide, calcium carbonate or calcium sulfate, for example, and those in which the support itself consists of a hydrophobic resin which contains a dispersion of a light reflecting substance. Examples include baryta paper, polyethylene covered paper, polypropylene based synthetic papers, or transparent supports, such as glass plates, polyester films such as polyethyleneterephthalate films, cellulose triacetate films or cellulose acetate films, polyamide films, polycarbonate films, polystyrene films or poly(vinyl chloride) resin films which are used conjointly with a reflective layer or with which a reflective substance is used conjointly, and these supports can be selected appropriately according to the intended purpose of the photosensitive material.

The use of white pigments which have been thoroughly milled in the presence of a surfactant or of which the surface of the pigment particles has been treated with a di-, tri- or tetra-hydric alcohol as a light reflecting substance is preferred.

The occupied area fraction (%) with respect to a specified unit area of the fine white pigment grains is typically obtained by dividing the area observed into adjoining unit areas measuring 6 $\mu m \times 6$ $\mu m$ and measuring the occupied area fraction (%) ($R_i$) of the fine particles projected in each unit area. The variation coefficient for the occupied area fraction (%) can be obtained by means of the ratio $s/\bar{R}$ of the standard deviation S of $R_i$ with respect to the average Value ($\bar{R}$) of $R_i$. The number (n) of unit areas Observed is preferably at least 6. Thus, the variation coefficient $s/\bar{R}$ can be obtained from the following expression:

$$\sqrt{\frac{\sum_{i=1}^{n} (Ri - \bar{R})^2}{n-1}} \Big/ \frac{\sum_{i=1}^{n} Ri}{n}$$

The variation coefficient of the occupied area fraction (%) of the fine pigment particles is preferably not more than 0.15 and most desirably not more than 0.12. Cases in which this variation coefficient has a value of not more than 0.08 are such that the dispersion of the particles in practice can be said to be uniform.

The scanning exposure light sources which can be used in the invention are described below. Any light source can be used in this invention provided that it satisfies the essential requirement of providing blue light, green light and red light, but the use of laser light as the light source is preferred because it is easy to control the time and the amount of light required for a scanning exposure. Moreover, light sources comprising a combination of a semiconductor laser and a wavelength conversion element consisting of a non-linear optical material is preferred from the point of view of the life expectancy and size of the apparatus.

The wavelength conversion elements comprised of non-linear optical materials which can be used in this invention are described below. Thus, a non-linear optical material is a material with which non-linear properties—a non-linear optical effect—can be observed in respect of polarization and the electric field when a strong photoelectric field such as laser light is applied, and known compounds of this type include inorganic compounds as typified by lithium niobate, potassium dihydrogen phosphate (KDP), lithium iodate and $BaB_2O_4$, and organic compounds including urea derivatives and nitroaniline derivatives (for example, 2-methyl-4-nitroaniline (MNA), 2-N,N-dimethylamino-5-nitroacetoanilide (DAN), m-nitroaniline, L-N-(4-nitrophenyl)-2-(hydroxymethyl)pyrrolidine and the compounds disclosed in the specifications of JP-A-62-210430, 62-210432 and 62-187828), nitropyridine-N-oxide derivatives (for example, 3-methyl-4-nitropyridine-1-oxide (POM)), diacetylene derivatives (for example, the compounds disclosed in JP-A-56-43220), the compounds disclosed in JP-A-61-60638, JP-A-61-78748, JP-A-61-152647, JP-A-61-137136, JP-A-61-147238, JP-A-61-148433 and JP-A-61-167930, and the compounds described by J. Williams in a paper entitles *Non-linear Optical Properties of Organic and Polymeric Materials*, ACS Symposium Series 233 (American Chemical Society, 1983) and by Kato and Nakanishi in *Organic Non-linear Optical Materials* (C.M.C. Co., 1985).

In connection with this invention, those substances which have a high transmittance for blue light from among these compounds, for example, KDP, lithium iodate, lithium niobate, $BaB_2O_4$, urea, POM and the compounds disclosed in JP-A-62-210430 and JP-A-62-210432 are preferred and POM and the organic compounds disclosed in JP-A-62-210430 and JP-A-62-210432 are especially desirable.

In practical terms, the use of compounds which can be represented by the general formula (VII) or the general formula (VIII) as indicated below as organic non-linear optical materials is especially desirable.

General Formula (VII)

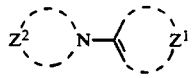

In this formula, $Z^1$ represents a group of atoms which is required to form a five or six membered aromatic ring which has at least one nitro group as a substituent group. $Z^2$ represents a group of atoms which is required to form a pyrrole ring, an imidazole ring, a pyrazole ring, a triazole ring or a tetrazole ring which may have substituent groups and condensed rings.

General Formula (VIII)

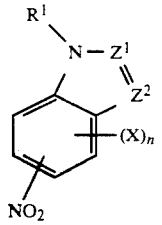

In formula (VIII , $Z^1$ and $Z^2$ may be the same or different, each representing a nitrogen atom or a $=CR^2$ group.

X represents an alkyl group, an aryl group, a halogen atom, an alkoxy group, an aryloxy group, an acylamino group, a carbamoyl group, a sulfamoyl group, an acyloxy group, an alkoxycarbonyl group, an aryloxycarbonyl group, an alkoxysulfonyl group, an aryloxysulfonyl group, an alkylthio group, an arylthio group, a hydroxyl group, a thio group, a carboxyl group, a ureido group, a cyano group, an alkylsulfonyl group, an arylsulfonyl group, an alkylsulfinyl group, an arylsulfinyl group or a nitro group. Moreover, n represents 0 or an integer of value from 1 to 3. $R^1$ represents a hydrogen atom, an alkyl group, an aryl group or an acyl group and $R^2$ represents a hydrogen atom, an alkyl group or an aryl group. Moreover, the alkyl groups and aryl groups included among the groups represented by X, $R^1$ and $R^2$ may themselves have substituent groups.

The non-linear optical effects include second harmonic generation, optical mixing, parametric oscillation, photo-rectification and the Pockels effect as second order effects and third harmonic generation, the Kerr effect, photo-pairing stability and light mixing as third order effects, and there are also effects of higher orders. In this invention, the purpose of the non-linear optical material is to convert semiconductor laser light of a wavelength in the infrared region to a wavelength in the visible region, and so of the effects mentioned above those which relate the wavelength changes, namely second harmonic generation, light mixing, parametric oscillation and third harmonic generation, are of importance.

Single crystal light guide type devices and fiber type devices are known embodiments of wavelength conversion elements in which semiconductor lasers and non-linear optical materials are used which can be used in the invention.

The plate type guides disclosed in JP-A-51-142284, JP-A-52-108779 and JP-A-52-125286, the embedded guides disclosed in JP-A-60-14222, JP-A-60-57825 and JP-A-60-112023, and the tapered guides disclosed in JP-A-60-250334 can be used a light guides. Fiber type devices include those that satisfy the phase matching conditions of the input laser wave and the converted laser wave disclosed in JP-A-57-211125.

The development processing which can be used in this invention after carrying out a scanning exposure in the way described above is described below.

Development processing can be carried out using wet methods or dry methods. Thermal development as disclosed, for example, in European Patent Application (laid open) (EP) No. 76,492A2 can be used for dry type processing. Furthermore, black and white developers (or alkali activators) can be used in instant systems (for example, in color diffusion transfer systems in which redox compounds which release diffusible dyes are used) as wet processing methods, but the use of color development baths is preferred as a wet processing method. The color development baths are aqueous alkaline solutions which contain primary aromatic amine based color developing agents as the principal components. Aminophenol based compounds are useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethyl aniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used conjointly, depending on the intended purpose.

The color development baths generally contain pH buffers, such as alkali metal carbonates, borates or phosphates, and development inhibitors or anti-fogging agents, such as bromides, iodides, benzimidazoles, benzothiazoles or mercapto compounds, for example. They may also contain, as required, various preservatives, such as hydroxylamine, diethylhydroxylamine, hydrazine sulfites, phenylsemicarbazides, triethanolamine, catechol sulfonic acids, triethylenediamine(1,4-diazabicyclo[2,2,2]octane) for example, organic solvents such as ethylene glycol and diethylene glycol, development accelerators such as benzyl alcohol, poly(ethylene glycol), quaternary ammonium salts and amines, dye forming couplers, competitive couplers, fogging agents such as sodium borohydride, auxiliary developing agents such as 1-phenyl-3-pyrazolidone, viscosity imparting agents, various chelating agents, as typified by the aminopolycarboxylic acids, aminopolyphosphonic acids, alkylphosphonic acids and phosphonocarboxylic acids, typical examples of which include ethylenediamine tetraacetic acid, nitrilo triacetic acid, diethylenetriamine pentaacetic acid, cyclohexanediamine tetraacetic acid, hydroxyethylimino diacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine di(o-hydroxyphenylacetic acid), and salts of these compounds.

Color development is carried out after a normal black and white development in the case of reversal processing. The known black and white developing agents, for example, dihydroxybenzenes such as hydroquinone, 3-pyrazolidones such as 1-phenyl-3-pyrazolidone, and aminophenols such as N-methyl-p-aminophenol, can be used individually, or in combinations, in the black and white development bath.

The pH of these color developers and black and white developers is generally within the range from about 9 to about 12. Furthermore, the replenishment rate of these development baths depends on the color photographic material which is being processed, but it is generally less than 3 liters per square meter of photosensitive material and it is possible, by reducing the bromide ion concentration in the replenisher, to use a replenishment rate of less than about 500 ml per square meter of photosensitive material. Prevention of the loss of liquid by evaporation, and prevention of aerial oxidation, by minimizing the contact area with the air in the processing tank is desirable in cases where the replenishment rate is low. The replenishment rate can be reduced further by using a means of suppressing the accumulation of bromide ion in the developer.

The photographic emulsion layers are normally subjected to a bleaching process after color development. The bleaching process may be carried out at the same time as the fixing process (in a bleach-fix process) or it may be carried out as a separate process. Moreover, a bleach-fix process can be carried out after a bleaching process in order to speed-up processing. Moreover processing can be carried out in two connected bleach-fix baths, a fixing process can be carried out before carrying out a bleach-fix process or a bleaching process can be carried out after a bleach-fix process, according to the intended purpose of the processing. Compounds of a multi-valent metal, such as iron(III), cobalt(III), chromium(VI) and copper(II), peracids quinones and nitro compounds, etc. can be used as bleaching agents. Typical bleaching agents include ferricyanides; dichromates; organic complex salts of iron(III) or cobalt(III), for example, complex salts with aminopolycarboxylic acids, such as ethylenediamine tetraacetic acid, diethylenetriamine pentaacetic acid, cyclohexanediamine tetraacetic acid, methylimino diacetic acid, 1,3-diaminopropane tetraacetic acid and glycol ether diamine tetraacetic acid, etc., or citric acid, tartaric acid, malic acid, etc.; persulfates; bromates; permanganates and nitrobenzenes, etc. Of these materials, the use of the aminopolycarboxylic acid iron(III) complex salts, principally ethylenediamine tetraacetic acid iron(III) complex salts, and persulfates, is preferred from the points of view of both rapid processing and the prevention of environmental pollution. Moreover, the amino polycarboxylic acid iron(III) complex salts are especially useful in both bleach baths and bleach-fix baths. The pH of a bleach or bleach-fix bath in which aminopolycarboxylic acid iron(III) complex salts is being used is normally from about 5.5 to about 8, but processing can be speeded up by using a lower pH.

Bleach accelerators can be used, as required, in the bleach baths, bleach-fix baths, or bleach or bleach-fix pre-baths. Actual examples of useful bleach accelerators have been disclosed in the following specifications: Thus there are the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (July 1978); the thiazolidine derivatives disclosed in JP-A-50-140129; the thiourea derivatives disclosed in JP-B-45-8506, JP-A-52-20832, JP-A-53-32735, and U.S. Pat. No. 3,706,561; the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-42434, JP-A-49-59644, JP-A-53-94927, JP-A-54-35727, JP-A-55-26506 and JP-A-58-163940; and bromide ions, etc. Among these compounds, those which have a mercapto group or a disulfide group are preferred in view of their large accelerating effect, and the use of the compounds disclosed in U.S. Pat. No. 3,893,858, West German Patent 1,290,812 and JP-A-53-95630 is especially desirable. Moreover, the use of the compounds disclosed in U.S. Pat. No. 4,552,834 is also desirable. These bleach accelerators may be added to the sensitive material. These bleach accelerators are especially effective when bleach-fixing color photosensitive materials for photography.

Thiosulfates, thiocyanates, thioether based compounds, thioureas, and large quantities of iodides, for example, can be used as fixing agents, but thiosulfates are generally used for this purpose and ammonium thiosulfate, in particular, can be used in the widest range of applications. Sulfites or bisulfites, or carbonyl-bisulfite addition compounds, are the preferred preservatives for bleach-fix baths.

The silver halide color photographic materials of this invention are generally subjected to a water washing and/or stabilizing process after the desilvering process. The amount of water used in the water washing process can be fixed within a wide range according to the nature of the photosensitive material (for example, the materials, such as couplers, which are being used), the application of the photosensitive material and the wash water temperature, the number of washing tanks (the number of washing stages), the replenishment system, i.e. whether a counter-flow or a sequential-flow system is used, and various other conditions. The relationship between the amount of water used and the number of water washing tanks in a multi-stage counter-flow system can be obtained using the method outlined on pages 248–253 of *Journal of the Society of Motion Picture and Television Engineers,* Volume 64 (May 1955).

The amount of wash water can be greatly reduced by using the multi-stage counter-flow system noted in the aforementioned literature, but bacteria proliferate due to the increased residence time of the water in the tanks and problems arise as a result of the sediments which are formed becoming attached to the photosensitive material. The method in which the calcium ion and manganese ion concentrations are reduced as disclosed in JP-A-62-288838 can be used very effectively to overcome problems of this sort in the processing of color photosensitive materials of this invention. Furthermore, the isothiazolone compounds and thiabendazoles disclosed in JP-A-57-8542, and chlorine based disinfectants such as chlorinated sodium isocyanurate, and benzotriazoles, etc., and the disinfectants disclosed in *Chemistry of Biocides and Fungicides* by Horiguchi (1986), *Killing Microorganisms, Biocidal and Fungicidal Techniques,* published by the Health and Hygiene Technical Society, and in *A Dictionary of Biocides and Fungicides,* published by the Japanese Biocide and Fungicide Society, can be used for this purpose.

The pH value of the wash water used in the processing of the photosensitive materials of invention is within the range from about 4 to about 9, and preferably within the range from about 5 to about 9. The wash water temperature and the washing time can be set variously according to the nature of the photosensitive material and the application etc. but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can all be used for this purpose.

Furthermore, there are cases in which a stabilization process is carried out following the aforementioned water washing process, and the stabilizing baths which contain formalin and surfactant which are used as a final bath for camera color photosensitive materials are an example of such a process. Various chelating agents and fungicides etc. can be added to these stabilizing baths.

The overflow which accompanies replenishment of the above-mentioned wash water and/or stabilizer can be re-used in other processes such as the desilvering process etc.

A color developing agent may also be incorporated into the silver halide color photosensitive materials of this invention in order to simplify and speed-up processing. The incorporation of various color developing agent precursors is preferred. For example, the indoaniline based compounds disclosed in U.S. Pat. No. 3,342,597, the Schiff's base type compounds disclosed in U.S. Pat. No. 3,342,599 and *Research Disclosure* Nos. 14850 and 15159, the aldol compounds disclosed in *Research Disclosure* No. 13924, the metal salt complexes disclosed in U.S. Pat. No. 3,719,492, and the urethane based compounds disclosed in JP-A-53-135628 can be used for this purpose.

Various 1-phenyl-3-pyrazolidones can be incorporated, as required, into the silver halide color photosensitive materials of this invention with a view to accelerating color development. Typical compounds of this type have been disclosed, for example, in JP-A-56-64339, JP-A-57-144547 and JP-A-58-115438.

The various processing baths in this invention are used at a temperature of from 10° C. to 50° C. The standard temperature is normally from 33° C. to 38° C., but processing is accelerated and the processing time is shortened at higher temperatures and, conversely, increased picture quality and improved stability of the processing baths can be achieved at lower temperatures. Furthermore, processes using hydrogen peroxide intensification or cobalt intensification as disclosed in West German Patent 2,226,770 or U.S. Pat. No. 3,674,499 can be carried out in order to economize on silver in the photosensitive material.

In order to realize the excellent advantages of the silver halide photographic photosensitive materials of this invention to the full, the silver halide photographic materials which have at least one layer which contains silver halide grains of this invention and couplers which form dyes by means of a coupling reaction with the oxidized form of a primary aromatic amine developing agent on a light reflecting support are preferably processed with a development time of not more than 2 minutes 30 seconds in an essentially benzyl alcohol free color development bath which contains not more than 0.002 mol/liter of bromide ion.

The term "essentially benzyl alcohol free" as used herein signifies that the benzyl alcohol concentration in the color developer is not more than 2 ml/liter and preferably not more than 0.5 ml/liter, and most desirably that the color development bath contains no benzyl alcohol at all.

No limitation is imposed upon the application of the invention, but some typical applications are indicated below.

1) For the image processing and reprinting of prints (positive images, such as color prints, instant photographs, posters, and slides, etc., and negative images such as negative films) with the conjoint use of a color analyzer.

2) For making prints from a CRT output, such as computer graphics, video pictures, electronic still pictures and images such as those used for medical diagnostic purposes.

3) For the output of images information which has been sent via a communication line, for example.

The invention is described in more detail below on the basis of illustrative examples, but the invention is not limited by these examples.

The exposing apparatus used in the examples is described below.

Exposing Apparatus 1

A GaAs semiconductor laser (oscillating wavelength approx. 900 nm), an InGaAs semiconductor laser (oscillating wavelength approx. 1100 nm) and an InGaAs semiconductor lasers (oscillating wavelength approx. 1300 nm) were used for the semiconductor lasers and second harmonics (approx. 450 nm, 550 nm and 650 nm) were obtained using fiber type elements with TRI, a non-linear optical material, as a crystal inside a glass fiber. The apparatus was such that the wavelength converted blue, green and red laser light was directed onto color printing paper, which was being moved perpendicular to the scanning direction, by means of a rotating polygonal body and the paper was subjected to a sequential scanning exposure. The exposure was controlled electronically by controlling the light outputs of the semiconductor lasers.

Chemical Structure of TRI

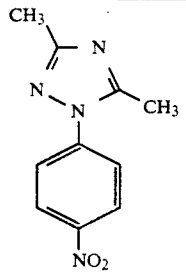

Exposing Apparatus 2

Similar to exposing apparatus 1, except that an LD excited YAG laser was used for the green light source.

Exposing Apparatus 3

A GaAs semiconductor laser (oscillating wavelength approx. 900 nm) and an InGaAs semiconductor laser (oscillating wavelength approx. 1300 nm) were used for the semiconductor lasers, the light was mixed using a dichroic mirror and second harmonics of two wavelengths (approx. 450 nm and 650 nm) and a two wavelength sum wave (532 nm) were obtained by directing the laser light into a fiber type element with TRI, a non-linear optical material, as a crystal inside a glass fiber. The apparatus was such that wavelength converted blue, green and red laser light was directed onto color printing paper, which was being moved perpendicular to the scanning direction, by means of a rotating polygonal body to which filters were attached and the paper was subjected to a sequential scanning exposure. The exposure was controlled electronically by controlling the light outputs of the semiconductor lasers.

Exposing Apparatus 4

A GaAs semiconductor laser (oscillating wavelength approx. 920 nm) and an InGaAs semiconductor laser (oscillating wavelength approx. 1300 nm) were used for the semiconductor lasers, the light was mixed using a dichroic mirror and second harmonics of two wavelengths (approx. 460 nm and 650 nm) and a two wavelength sum wave (539 nm) were obtained by directing the laser light into a fiber type element with PRA (3,5-dimethyl-1-(4-nitrophenyl)pyrazole), a non-linear optical material, as a crystal inside a glass fiber. The apparatus was such that wavelength converted blue, green and red laser light was directed onto color printing paper, which was being moved perpendicular to the scanning direction, by means of a rotating polygonal body to which filters were attached and the paper was subjected to a sequential scanning exposure.

EXAMPLE 1

Sodium chloride (6.4 grams) was added to a 3% aqueous solution of lime treated gelatin and 3.2 ml of N,N'-dimethylimidazolidin-2-thione (as a 1% aqueous solution) was added. An aqueous solution containing 0.2 mol of silver nitrate and a first aqueous alkali metal halide solution containing 0.08 mol of potassium bromide and 0.12 mol of sodium chloride were then added to, and mixed with, this solution at 52° C. with vigorous agitation. Next, an aqueous solution containing 0.8 mol of silver nitrate and a second aqueous alkali metal solution containing 0.32 mol of potassium bromide and 0.48 mol of sodium chloride were added to, and mixed with, the resulting mixture at 52° C. with vigorous agitation. 2-[5-Phenyl-2-{-2-[5-phenyl-3(2-sulfonatoethyl)benzoxazolin-2-ylidenemethyl]-1-butenyl}-3-benzoxazolio]ethanesulfonic acid, pyridinium salt, (286.7 mg) was added 1 minute after the addition of the aqueous silver nitrate and second aqueous alkali metal halide solutions had been completed. The temperature was then maintained at 52° C. for a period of 15 minutes, after which the emulsion was de-salted and washed with water. Then, a further 90.0 grams of lime treated gelatin was added, triethylthiourea was added and the mixture was chemically sensitized optimally to provide a surface latent image type emulsion. The silver chlorobromide (40 mol % silver bromide) emulsion so obtained was Emulsion A-1.

Emulsion A-2 was prepared in the same way as Emulsion A-1, except that 0.1 mg of the potassium salt of hexachloroiridium(IV) was added to the second aqueous alkali metal halide solution.

Next, sodium chloride (6.4 grams) was added to a 3% aqueous solution of lime treated gelatin and 3.2 ml of N,N'-dimethylimidazolidin-2-thione (as a 1% aqueous solution) was added. An aqueous solution containing 0.2 mol of silver nitrate and a first aqueous alkali metal halide solution containing 0.04 mol of potassium bromide and 0.16 mol of sodium chloride were then added to, and mixed with, this solution at 52° C. with vigorous agitation. Next, an aqueous solution containing 0.8 mol of silver nitrate and a second aqueous alkali metal halide solution containing 0.16 mol of potassium bromide and 0.64 mol of sodium chloride were added to, and mixed with, the resulting mixture at 52° C. with vigorous agitation. 2-[5-Phenyl-2-{-2-[5-phenyl-3(2-sulfonatoethyl)benzoxazolin-2-ylidenemethyl]-1-butenyl}-3-benzoxazolio]ethanesulfonic acid, pyridinium salt, (286.7 mg) was added 1 minute after the addition of the aqueous silver nitrate and second aqueous alkali metal halide solutions had been completed. The temperature was then maintained at 52° C. for a period of 15 minutes, after which the emulsion was de-salted and washed with water. Then, a further 90.0 grams of lime treated gelatin was added, triethythiourea was added and the mixture was chemically sensitized optimally to provide a surface latent image type emulsion. The silver chlorobromide (20 mol % silver bromide) emulsion so obtained was Emulsion B-1.

Emulsion B-2 was prepared in the same way as Emulsion B-1, except that 0.1 mg of the potassium salt of hexachloroiridium(IV) was added to the second aqueous alkali metal halide solution.

Next, sodium chloride (3.3 grams) was added to a 3% aqueous solution of lime treated gelatin and 3.2 ml of N,N'-dimethylimidazolidin-2-thione (as a 1% aqueous solution) was added. An aqueous solution containing 0.2 mol of silver nitrate and a first aqueous alkali metal halide solution containing 0.2 mol of sodium chloride were then added to, and mixed with, this solution at 52° C. with vigorous agitation. Next, an aqueous solution containing 0.55 mol of silver nitrate and a second aqueous alkali metal halide solution containing 0.55 mol of sodium chloride were added to, and mixed with, the resulting mixture at 52° C. with vigorous agitation. Next, an aqueous solution containing 0.25 mol of silver nitrate and a third aqueous alkali metal halide solution containing 0.25 mol of potassium bromide and 0.05 mol of sodium chloride were added to, and mixed with, the resulting mixture at 52° C. with vigorous agitation. 2-[5-Phenyl-2-{-2-(5-phenyl-3(2-sulfonatoethyl)benzoxazolin-2-ylidenemethyl]-1-butenyl}3-benzoxazolio]ethanesulfonic acid, pyridinium salt, (286.7 mg) was added 1 minute after the addition of the aqueous silver nitrate and third aqueous alkali metal halide solutions had been completed. The temperature was then maintained at 52° C. for a period of 15 minutes, after which the emulsion was de-salted and washed with water. Then, a further 90.0 grams of lime treated gelatin was added, triethythiourea was added and the mixture was chemically sensitized optimally to provide a surface latent image type emulsion. The silver chlorobromide (20 mol % silver bromide) emulsion so obtained was Emulsion C-1.

Emulsion C-2 was prepared in the same way as Emulsion C 1, except that 0.1 mg of the potassium salt of hexachloroiridium(IV) was added to the third aqueous alkali metal halide solution.

Next, sodium chloride (3.2 grams) was added to a 3% aqueous solution of lime treated gelatin and 3.3 ml of N,N'-dimethylimidazolidin-2-thione (as a 1% aqueous solution) was added. An aqueous solution containing 0.2 ml of silver nitrate and a first aqueous alkali metal halide solution containing 0.004 mol of potassium bromide and 0.196 mol of sodium chloride were then added to, and mixed with, this solution at 52° C. with vigorous agitation. Next, an aqueous solution containing 0.8 of silver nitrate and a second aqueous alkali metal halide solution containing 0.016 mol of potassium bromide and 0.784 mol of sodium chloride were added to, and mixed with, the resulting mixture at 52° C. with vigorous agitation. 2-[5-Phenyl-2-{-2-[5-phenyl-3(2-sulfonatoethyl)benzoxazolin-2-ylidenemethyl]-1-butenyl}-3-benzoxazolio]ethanesulfonic acid, pyridinium salt, (286.7 mg) was added 1 minute after the addition of the aqueous silver nitrate and second aqueous alkali metal halide solutions had been completed. The temperature was then maintained at 52° C. for a period of 15 minutes, after which the emulsion was de-salted and washed with water. Then, a further 90.0 grams of lime treated gelatin was added, triethythiourea was added and the mixture was chemically sensitized optimally to provide a surface latent image type emulsion. The silver chlorobromide (2 mol % silver bromide) emulsion so obtained was Emulsion D-1.

Emulsion D-2 was prepared in the same way as Emulsion D-1, except that 0.1 mg of the potassium salt of hexachloroiridium(IV) was added to the second aqueous alkali metal halide solution.

Next, sodium chloride (3.3 grams) was added to a 3% aqueous solution of lime treated gelatin and 3.2 ml of N,N'-dimethylimidazolidin-2-thione (as a 1% aqueous solution) was added. An aqueous solution containing 0.2 ml of silver nitrate and a first aqueous alkali metal halide solution containing 0.2 mol of sodium chloride were then added to, and mixed with, this solution at 52° C. with vigorous agitation. Next, an aqueous solution containing 0.775 of silver nitrate and a second aqueous alkali metal halide solution containing 0.775 mol of sodium chloride were added to, and mixed with, the resulting mixture at 52° C. with vigorous agitation. 2-[5-Phenyl-2-{-2-[5-phenyl-3(2-sulfonatoethyl)benzoxazolin-2-ylidenemethyl]-1-butenyl}-3-benzoxazolio]ethanesulfonic acid, pyridinium salt, (286.7 mg) was added 1 minute after the addition of the aqueous silver nitrate and second aqueous alkali metal halide solutions had been completed. The temperature was then maintained at 52° C. for a period of 15 minutes, after which an aqueous solution containing 0.025 mol of silver nitrate and a third aqueous alkali metal halide solution containing 0.02 mol of potassium bromide and 0.005 mol of sodium chloride were added to, and mixed with, the resulting solution at 40° C. with vigorous agitation. The emulsion was then de-salted and washed with water. Then, a further 90.0 grams of lime treated gelatin was added, triethythiourea was added and the mixture was chemically sensitized optimally to provide a surface latent image type emulsion. The silver chlorobromide (2 mol % silver bromide) emulsion so obtained was Emulsion E-1.

Emulsion E-2 was prepared in the same way as Emulsion E 1, except that 0.1 mg of the potassium salt of hexachloroiridium(IV) was added to the third aqueous alkali metal halide solution.

The form of the grains, the grain size and the grain size distribution of each of the Emulsions A-1 to E-2 prepared in this way were obtained from electron micrographs. The silver halide grains contained in all the emulsions from A-1 to E-2 had a cubic form. The grain size was expressed in terms of the average value of the diameters of the circles equivalent to the projected areas of the grains, and the value obtained by dividing the standard deviation of the grain size by the average grain size was used to represent the grain size distribution. The results obtained were as shown in Table 1.

The halogen compositions of the emulsified grains were determined by measuring the X-ray diffraction due to the silver halide crystals. The mono-chromatic CuKα line was used as the X-ray source and the diffraction angles of the diffraction lines from the (200) plane were measured in detail. Crystals which have a uniform halogen composition give a single diffraction peak, whereas crystals which have local phases of different composition give a plurality of diffraction peaks corresponding to the compositions of the different phases. The lattice constants can be calculated from the diffraction angles of the measured peaks and it is then possible to determine the halogen composition of the silver halide from which the crystals are built. The results obtained are summarized in Table 2.

TABLE 1

| Emulsion | Form | Grain Size, μ | (Distribution) |
|---|---|---|---|
| A-1 | Cubic | 0.49 | (0.09) |
| A-2 | " | 0.49 | (0.09) |
| B-1 | " | 0.51 | (0.08) |
| B-2 | " | 0.51 | (0.08) |
| C-1 | " | 0.51 | (0.09) |
| C-2 | " | 0.51 | (0.09) |
| D-1 | " | 0.50 | (0.07) |
| D-2 | " | 0.50 | (0.07) |
| E-1 | " | 0.50 | (0.08) |
| E-2 | " | 0.50 | (0.08) |

TABLE 2

| | | | Remarks | |
|---|---|---|---|---|
| Emulsion | Main Peaks | Auxiliary Peaks | Local AgBr Phase | Polyvalent Metal Ion Impurity |
| A-1 | Cl 60%, (Br 40%) | — | No | — |
| A-2 | Cl 60%, (Br 40%) | — | No | Ir (IV) |
| B-1 | Cl 80%, (Br 20%) | — | No | — |
| B-2 | Cl 80%, (Br 20%) | — | No | Ir (IV) |
| C-1 | Cl 100% | Cl 34%-90% | Yes | — |
| C-2 | Cl 100% | Cl 34%-90% | Yes | Ir (IV) |
| D-1 | Cl 98%, (Br 2%) | — | No | — |
| D-2 | Cl 98%, (Br 2%) | — | No | Ir (IV) |
| E-1 | Cl 100% | Cl 61%-90% | Yes | — |
| E-2 | Cl 100% | Cl 61%-90% | Yes | Ir (VI) |

Next, 29.6 grams of the magenta coupler (a), 5.9 grams of the colored image stabilizer (b) and 11.8 grams of the colored image stabilizer (c) were mixed with 30.0 ml of ethyl acetate and 38.5 ml of the solvent (d) to form a solution and this solution was emulsified and dispersed in 320 ml of a 10% aqueous gelatin solution which contained 20 ml of 10% sodium dodecylbenzenesulfonate.

The coupler emulsion was mixed with the emulsions obtained in the way described above to prepare coating liquids of which the compositions are shown in Table 3, and these emulsions were coated to provide the layer structures shown in Table 3 on paper supports which have been laminated on both sides with polyethylene to provide a total of ten types of photosensitive material. Moreover, 1-oxy-3,5-dichloro-s-triazine, sodium salt, was used as a gelatin hardening agent in each layer.

TABLE 3

| | | | |
|---|---|---|---|
| Third Layer | (Protective Layer) | | 1.50 g/m$^2$ |
| | Gelatin | | |
| Second Layer | (Green Sensitive Layer) | | |
| | Silver chloro(bromide) emulsion (A-1-E-2, amount calc. as Ag) | | 0.36 g/m$^2$ |
| | Magenta coupler | (a) | 0.32 g/m$^2$ |
| | Colored image stabilizer | (b) | 0.06 g/m$^2$ |
| | Colored image stabilizer | (c) | 0.13 g/m$^2$ |
| | Solvent | (d) | 0.42 ml/m$^2$ |
| | Gelatin | | 1.00 g/m$^2$ |
| Support, | laminated on both sides with polyethylene | | |
| | $TiO_2$ and ultramarine were included in the poly- | | |

TABLE 3-continued ethylene on the first layer side of the support.

(a) Magenta Coupler

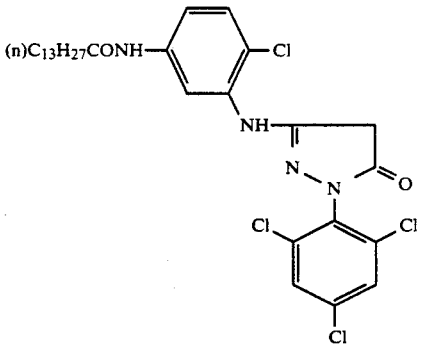

(b) Colored Image Stabilizer

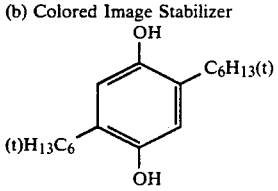

(c) Colored Image Stabilizer

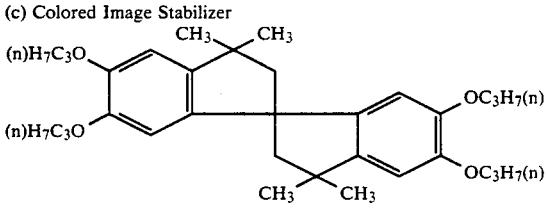

(d) Solvent

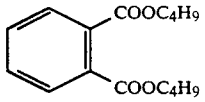

Furthermore, the compound indicated below was added at a rate of 125 mg/ml of silver halide to each of the coating liquids.

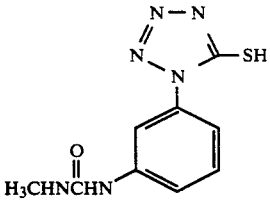

The properties of the emulsions which had been prepared were tested using the ten coated sample obtained in this way (the samples were given the same names as the emulsions).

In order to evaluate the extent of the difference in density between the parts where the exposure had started and the parts where the exposure had finished when making a scanning exposure, the samples were uniformly exposed with a single color using green light in exposing apparatus 1 in such a way that the magenta color density which was formed was about 1.0. The time taken from the start to the finish of the exposure was about 1 minute. The exposed samples were developed and processed immediately (about 10 seconds after exposure) using the development process and development bath indicated below.

The reflection density of the part of the processed samples so obtained at which the exposure started ($D_S$) and the reflection density of the part where the exposure finished ($D_E$) were measured and the change in density from the start to the finish of the exposure, $\Delta D = D_S - D_E$ was obtained.

The results obtained were as shown in Table below.

| Processing Operation | Temperature | Processing Time |
|---|---|---|
| Color development | 35° C. | 45 seconds |
| Bleach-fix | 35° C. | 45 seconds |
| Water wash (1) | 35° C. | 30 seconds |
| Water wash (2) | 35° C. | 30 seconds |
| Water wash (3) | 35° C. | 30 seconds |
| Drying | 75° C. | 60 seconds |

| | Parent Bath |
|---|---|
| Color Development Bath | |
| Water | 800 ml |
| Ethylenediamine-N,N,N',N'-tetra-methylenephosphonic acid | 3.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Bis(carboxymethyl)hydrazine | 5.0 g |
| Fluorescent whitener (Unitex CK, made by Ciba-Geigy) | 1.0 g |
| Water to make up to | 1000 ml |
| pH (25° C.) | 10.05 |
| Bleach-fix Bath | |
| Water | 400 ml |
| Ammonium thiosulfate (70%) | 100 ml |
| Sodium sulfite | 18 g |
| Ethylenediamine tetraacetic acid, ferric ammonium salt | 55 g |
| Ethylenediamine tetraacetic acid, di sodium salt | 3 g |
| Ammonium bromide | 40 g |
| Glacial acetic acid | 8 g |
| Water to make up to | 1000 ml |
| pH (25° C.) | 5.5 |
| Rinse Bath | |
| Ion exchanged water (calcium and magnesium both less than 3 ppm) | |

TABLE 4

| Sample | $D_S$ | $D_E$ | ΔD | Remarks |
|---|---|---|---|---|
| A-1 | 0.81 | 0.96 | −0.15 | Comparative Ex. |
| A-2 | 1.09 | 1.01 | +0.08 | Comparative Ex. |
| B-1 | 0.74 | 0.97 | −0.23 | Comparative Ex. |
| B-2 | 1.13 | 1.02 | +0.11 | Comparative Ex. |
| C-1 | 0.91 | 0.99 | −0.08 | This Invention |
| C-2 | 0.97 | 1.00 | −0.03 | This Invention |
| D-1 | 0.66 | 0.96 | −0.30 | Comparative Ex. |
| D-2 | 1.14 | 1.02 | +0.12 | Comparative Ex. |
| E-1 | 0.93 | 0.99 | −0.06 | This Invention |
| E-2 | 0.99 | 1.00 | −0.01 | This Invention |

The effect of the invention is clear from the results shown in Table 4. That is to say, Samples B-1 and D-1 in which emulsions with an silver bromide content of 20 mol % and of 2 mol % with a uniform structure had been used showed a large fall in density in the part where the scanning exposure started, while there was a large increase in the density with Samples B-2 and D-2 in which iridium had been used. However, with Samples C-1 and E-1 in which emulsions of which the silver bromide contents were 20 mol % and 2 mol % but in which the silver bromide was localized had been used, the fall in density in the part where the scanning exposure started was small and the effect of the invention is excellent. Moreover, the effect was still apparent when iridium was included in the emulsions which had a local silver bromide phase.

On the other hand, when a silver halide emulsion which had a silver bromide content of 40 mol % was used the change in density between the parts where the scanning exposure started and finished was smaller than that observed with the sample in which an emulsion with a smaller silver bromide content but which did not have a local silver bromide phase had been used, but it was larger than that observed with the samples in which an emulsion which did have a local phase had been used.

Moreover, when emulsions which had a silver bromide content of 40 mol % were used the results were unsatisfactory in terms of color reproduction when multi-layer photosensitive materials which had blue sensitive, green sensitive and red sensitive layers were prepared. This is described is Example 2 below.

EXAMPLE 2

Sodium chloride (5.8 grams) was added to a 3% aqueous solution of lime treated gelatin and 3.8 ml of N,N'-dimethylimidazolidin-2-thione (as a 1% aqueous solution) was added. An aqueous solution containing 0.04 mol of silver nitrate and a first aqueous alkali metal halide solution containing 0.016 mol of potassium bromide and 0.024 mol of sodium chloride were then added to, and mixed with, this solution at 75° C. with vigorous agitation. Next, an aqueous solution containing 0.93 mol of silver nitrate and a second aqueous alkali metal halide solution containing 0.384 mol of potassium bromide and 0.576 mol of sodium chloride were added to, and mixed with, the resulting mixture at 75° C. with vigorous agitation. 3-{-2-[5 Chloro-3-(3-sulfonatopropyl)benzoxazolin-2-ylidenemethyl]-1-naphtho-[1,2-d]-thiazolio}propanesulfonic acid, triethylammonium salt, (172.8 mg) was added 1 minute after the addition of the aqueous silver nitrate and aqueous alkali metal halide solutions had been completed. The temperature was then maintained at 75° C. for a period of 15 minutes, after which the emulsion was de-salted and washed with water. Then, a further 90.0 grams of lime treated gelatin was added, triethylthiourea was added and the mixture was chemically sensitized optimally to provide a surface latent image type emulsion. The silver chlorobromide (40 mol % silver bromide) emulsion so obtained was Emulsion F-1.

Emulsion F-2 was prepared in the same way as Emulsion F-1, except that 0.1 mg of the potassium salt of hexachloroiridium(IV) was added to the second aqueous alkali metal halide solution.

Next, sodium chloride (5.8 grams) was added to a 3% aqueous solution of lime treated gelatin and 3.8 ml of N,N'-dimethylimidazolidin-2-thione (as a 1% aqueous solution) was added. An aqueous solution containing 0.04 mol of silver nitrate and a first aqueous alkali metal halide solution containing 0.0008 mol of potassium bromide and 0.0392 mol of sodium chloride were then added to, and mixed with, this solution at 75° C. with vigorous agitation. Next, an aqueous solution containing 0.96 mol of silver nitrate and a second aqueous alkali metal halide solution containing 0.0192 mol of potassium bromide and 0.9408 mol of sodium chloride were added to, and mixed with, the resulting mixture at 75° C. with vigorous agitation. 3-{-2-[5-Chloro-3-(3-sulfonatopropyl)benzoxazolin-2-ylidenemethyl]-1-naphtho-[1,2-d]thiazolio}propanesulfonic acid, triethylammonium salt, (172.8 mg) was added 1 minute after the addition of the aqueous silver nitrate and aqueous alkali metal halide solutions had been completed. The temperature was then maintained at 75° C. for a period of 15 minutes, after which the emulsion was de-salted and washed with water. Then, a further 90.0 grams of lime treated gelatin was added, triethythiourea was added and the mixture was chemically sensitized optimally to provide a surface latent image type emulsion. The silver chlorobromide (2 mol % silver bromide) emulsion so obtained was Emulsion G-1.

Emulsion G-2 was prepared in the same way as Emulsion G-1, except that 0.1 mg of the potassium salt of hexachloroiridium(IV) was added to the second aqueous alkali metal halide solution.

Next, sodium chloride (5.8 9rams) was added to a 3% aqueous solution of lime treated gelatin and 3.8 ml of N,N'-dimethylimidazolidin-2-thione (as a 1% aqueous solution) was added. An aqueous solution containing 0.04 mol of silver nitrate and a first aqueous alkali metal halide solution containing 0.04 mol of sodium chloride were then added to, and mixed with, this solution at 75° C. with vigorous agitation. Next, an aqueous solution containing 0.935 mol of silver nitrate and a second aqueous alkali metal halide solution containing 0.935 mol of sodium chloride were added to, and mixed with, the resulting mixture at 75° C. with vigorous agitation. 3-{2-[5-Chloro-3-(3-sulfonatopropyl)benzoxazolin-2-ylidenemethyl]-3-naphtho-[1,2-d]-thiazolio}propanesulfonic acid, triethylammonium salt, (172.8 mg) was added 1 minute after the addition of the aqueous silver nitrate and the second aqueous alkali metal halide solutions had been completed. The mixture was maintained at 75° C. for 15 minutes, after which an aqueous solution containing 0.025 mol of silver nitrate and a .third aqueous alkali metal halide solution containing 0.02 mol of potassium bromide and 0.005 mol of sodium chloride were added to, and mixed with, the resulting mixture at 40° C. with vigorous agitation. After this, the emulsion was de-salted and washed with water. Then, a further 90.0 grams of lime treated gelatin was added, triethythiourea was added and the mixture was chemically sensitized optimally to provide a surface latent image type emulsion. The silver chlorobromide (2 mol % silver bromide) emulsion so obtained was Emulsion H-1.

Emulsion H-2 was prepared in the same way as Emulsion H-1, except that 0.1 mg of the potassium salt of hexachloroiridium(IV) was added to the third aqueous alkali metal halide solution.

Next, Emulsions I-1, I-2, J-1, J-2, K-1 and K-2 were prepared in the same way as Emulsions A-1, A-2, D-1, D-2, E-1 and E-2 in Example 1, except that the 286.7 mg of 2-[5-phenyl-2-[2-[5-phenyl-3-(2-sulfonatoethyl)benzoxazolin-2-ylidenemethyl]-1-butenyl]-3-benzoxazolio]ethanesulfonic acid, pyridinium salt, was replaced by 60.0 mg of 2-[2,4-(2,2-dimethyl-1,3-propano)-5-(6-methyl-3-pentylbenzothiazolin-2-ylidene)-1,3-pentadienyl]-3-ethyl-6-methylbenzothiazolium iodide.

The form of the grains, the grain size and the grain size distribution of the Emulsions F-1, F-2, G-1, G-2, H-1 and H-2 from among the emulsion prepared in this way are shown in Table 5.

Furthermore, the halogen composition of the emulsified grains was obtained in each case in the same way as described in Example 1 and the results obtained are summarized in Table 6.

TABLE 5

| Emulsion | Form | Grain Size, μ | (Distribution) |
|---|---|---|---|
| F-1 | Cubic | 1.01 | (0.08) |
| F-2 | " | 1.01 | (0.08) |
| G-1 | " | 1.03 | (0.07) |
| G-2 | " | 1.03 | (0.07) |
| H-1 | " | 1.03 | (0.07) |
| H-2 | " | 1.03 | (0.07) |

TABLE 6

| | | | Remarks | |
|---|---|---|---|---|
| Emulsion | Main Peaks | Auxiliary Peaks | Local AgBr Phase | Polyvalent Metal Ion Impurity |
| F-1 | Cl 60%, (Br 40%) | — | No | — |
| F-2 | Cl 60%, (Br 40%) | — | No | Ir (IV) |
| G-1 | Cl 98%, (Br 2%) | — | No | — |
| G-2 | Cl 98%, (Br 2%) | — | No | Ir (IV) |
| H-1 | Cl 100% | Cl 53%-90% | Yes | — |
| H-2 | Cl 100% | Cl 53%-90% | Yes | Ir (VI) |

The emulsions obtained in this way were multi-layer coated with the compositions, layer structure and emulsion compositions shown in Tables 7 and 8 to prepared six types of color photosensitive materials. The coating liquids were prepared in the way outlined below.

Preparation of the First Layer Coating Liquid

Ethyl acetate (27.2 ml) and 7.9 ml of solvent (d) were added to 19.1 grams of the yellow coupler (e) and 4.4 grams of the colored image stabilizer (f) to form a solution, and this solution was emulsified and dispersed in a 10% aqueous gelatin solution which contained 8.0 ml of 10% sodium dodecylbenzenesulfonate.

The aforementioned emulsified dispersion was then mixed with the silver chlorobromide emulsions indicated in Table 8 to provide the first layer coating liquids of which the composition is shown in Table 7.

The coating liquids for the second to seventh layers were prepared in the same way as the first layer coating liquid. However, the emulsified dispersion used in the fifth layer coating liquid was used after removing the ethyl acetate by distillation under reduced pressure at 40° C. after emulsification and dispersion.

The same compound as used in Example 1 was used as a gelatin hardening agent in each layer.

The structural formulae of the compounds such as the couplers etc. used in this example are indicated below.

(e) Yellow Coupler

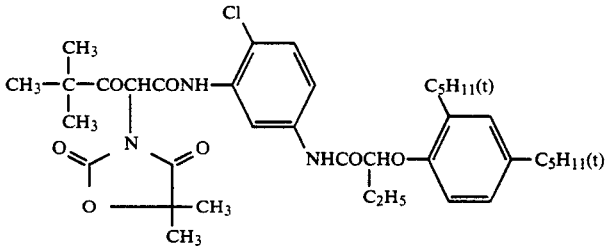

(f) Colored Image Stabilizer

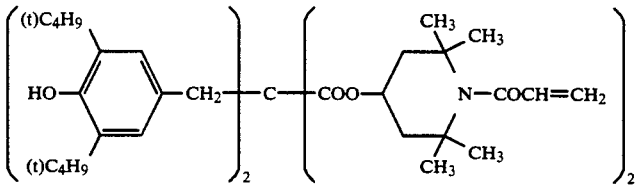

(g) Anti-color Mixing Agent

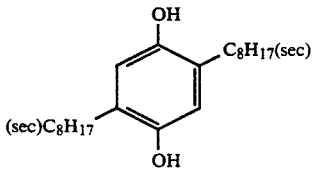

(h) Magenta Coupler

-continued
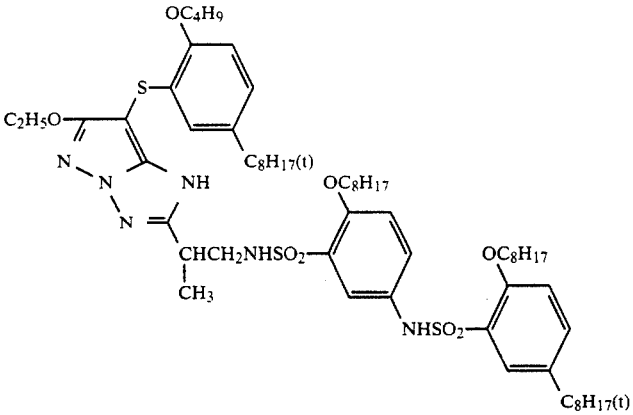
(i) Solvent
A 2:1 mixture (by weight) of:
$(C_8H_{17}O)_3-P=O$
and
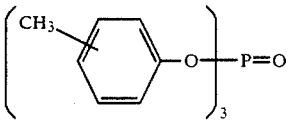
(j) Ultraviolet Absorber
A 1:5:3 mixture (mol ratio) of
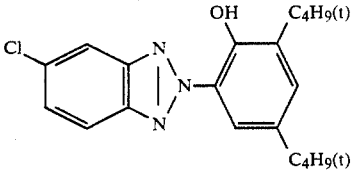
and
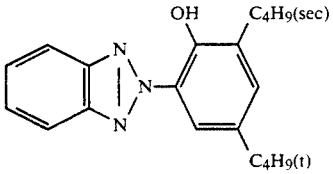
and
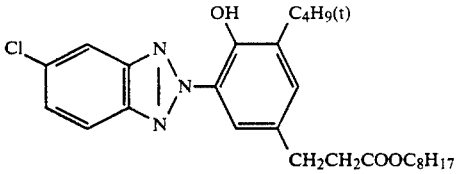
(k) Anti-color Mixing Agent
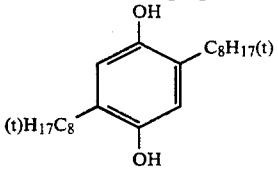
(l) Solvent
$COOCH_2CH(C_2H_5)C_4H_9$
|
$(CH_2)_8$
|
$COOCH_2CH(C_2H_5)C_4H_9$
(m) Cyan Coupler -continued

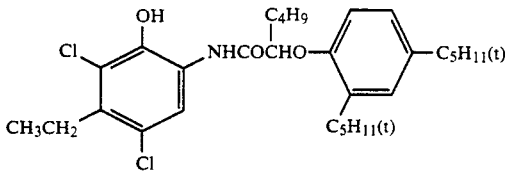

(n) Colored Image Stabilizer
A 1:3:3 mixture (mol ratio) of

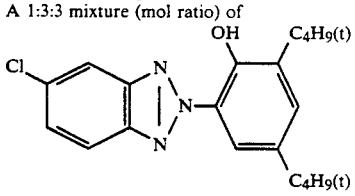

and

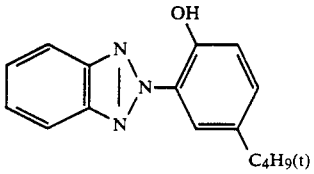

and

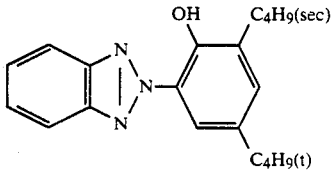

The compounds indicated below were used as anti-irradiation dyes in each layer:

For the green Sensitive Emulsion Layer

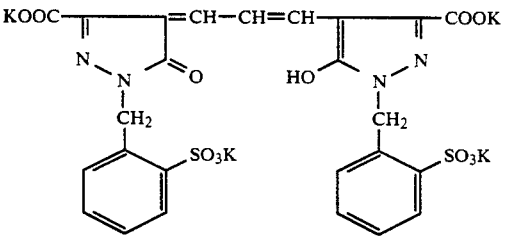

For the Red Sensitive Emulsion Layer

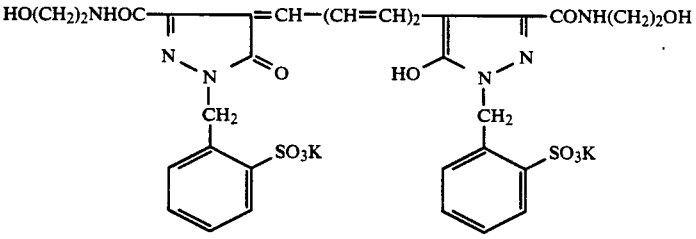

Furthermore, the compound indicated below was added to each coating liquid, being added at the rate of 50 mg/mol of silver halide to the blue sensitive emulsion layer and at the rate of 125 mg per mol of silver halide to the green sensitive and red sensitive emulsion layers.

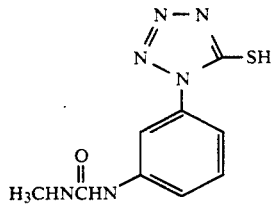

TABLE 7

| Layer Name | Composition | |
|---|---|---|
| Seventh Layer (Protective Layer) | Gelatin | 1.33 g/m$^2$ |
| | Acrylic modified poly(vinyl alcohol) (17% modification) | 0.17 g/m$^2$ |
| Sixth Layer (UV Absorbing Layer) | Gelatin | 0.54 g/m$^2$ |
| | Ultraviolet absorber (j) | 0.21 g/m$^2$ |
| | Solvent (1) | 0.09 g/m$^2$ |
| Fifth Layer (Red Sensitive Layer) | Silver halide emulsion (see Table 8) | 0.24 g/m$^2$ |
| | Gelatin | 0.96 g/m$^2$ |
| | Cyan coupler (m) | 0.38 g/m$^2$ |
| | Colored image stabilizer (n) | 0.17 g/m$^2$ |
| | Solvent (d) | 0.23 ml/m$^2$ |
| Fourth Layer (Anti-color Mixing Layer) | Gelatin | 1.60 g/m$^2$ |
| | Ultraviolet absorber (j) | 0.62 g/m$^2$ |
| | Anti-color mixing agent (k) | 0.05 g/m$^2$ |
| | Solvent (1) | 0.26 g/m$^2$ |
| Third Layer (Green Sensitive Layer) | Silver halide emulsion (see Table 8) | 0.16 g/m$^2$ |
| | Magenta coupler (h) | 0.45 g/m$^2$ |
| | Colored image stabilizer (c) | 0.20 g/m$^2$ |
| | Solvent (i) | 0.45 g/m$^2$ |
| Second Layer (Anti-color Mixing Layer) | Gelatin | 0.99 g/m$^2$ |
| | Anti-color mixing agent (g) | 1.80 g/m$^2$ |
| First Layer (Blue Sensitive Layer) | Silver halide emulsion (see Table 8) | 0.27 g/m$^2$ |
| | Gelatin | 1.86 g/m$^2$ |
| | Yellow coupler (e) | 0.74 g/m$^2$ |
| | Colored image stabilizer (f) | 0.17 g/m$^2$ |
| | Solvent (d) | 0.31 g/m$^2$ |
| Support | Paper support laminated on both sides with polyethylene ($TiO_2$ and ultramarine were included in the polyethylene on the first layer side) | |

The amount of each silver halide emulsion is indicated as the amount coated after calculation as silver.

TABLE 8

| | Emulsion Used in The: | | |
|---|---|---|---|
| Sample | Blue Sensitive Layer | Green Sensitive Layer | Red Sensitive Layer |
| i | F-1 | A-1 | I-1 |
| ii | F-2 | A-2 | I-2 |
| iii | G-1 | D-1 | J-1 |
| iv | G-2 | D 2 | J-2 |
| v | H-1 | E-1 | K-1 |
| vi | H-2 | E-2 | K-2 |

The six types of coated Sample i to vi obtained in this way were exposed under the two sets of exposure conditions indicated below using exposing apparatus 3.

1) The amounts of blue light, green light and red lighting the exposing apparatus were adjusted to give an gray density of about 1.0 and the samples were exposed uniformly at this exposure rate using a scanning exposure. The time required to complete the scanning exposure was about 1 minute 30 seconds.

2) A yellow color was formed using the blue light source of such an intensity as to provide a yellow density of 2.0.

Both the exposed samples in each case were developed and processed immediately (within 10 seconds of the completion of the exposure) in the same way as described in Example 1.

The density of the part at the start of the scanning exposure ($D_S$) and the density of the part at the end of the scanning exposure ($D_E$) were measured for yellow, magenta and cyan using the samples obtained using the first set of exposure conditions 1) and the values for $\Delta D$ were obtained in the same way as in Example 1.

The extent of color mixing of magenta and cyan in yellow development was investigated by measuring the respective densities using the samples obtained using the second set of exposure conditions 2).

The results obtained in both case are shown in Table 9.

TABLE 9

| | ΔD | | | Mixing in Yellow Part | | |
|---|---|---|---|---|---|---|
| Sample | Yellow | Magenta | Cyan | Magenta | Cyan | Remarks |
| i | −0.13 | −0.14 | −0.15 | 0.45 | 0.51 | Comparative Ex. |
| ii | +0.09 | +0.07 | +0.08 | 0.46 | 0.50 | Comparative Ex. |
| iii | −0.29 | −0.30 | −0.28 | 0.24 | 0.22 | Comparative Ex. |
| iv | +0.12 | +0.13 | +0.14 | 0.23 | 0.21 | Comparative Ex. |
| v | −0.05 | −0.06 | −0.05 | 0.22 | 0.23 | This Invention |
| vi | +0.01 | −0.01 | −0.02 | 0.23 | 0.21 | This Invention |

It is clear from the results shown in Table 9 that the effect of the invention is also pronounced in the case of multi-layer coated samples. That is to say, Sample iii in which an emulsion with a uniform structure with a silver bromide content of 2 mol % had been used was such that the fall in density in the part where the scanning exposure started was pronounced in the yellow, magenta, cyan layers, and with Sample iv in which iridium had also been used there was an increase in this density in all of the layers.

However, with Sample v in which a silver halide emulsion which had a silver bromide content of 2 mol % but which also had a local silver bromide phase had been used, the fall in density in the part where the scanning exposure started was small and the effect of the invention was excellent. Moreover, the effect of the invention was also seen when iridium was included in this emulsion which had a local silver bromide phase (Sample vi).

On the other hand, when a silver halide emulsion which had a silver bromide content of 40 mol % was used the change in density between the parts where the scanning exposure started and finished was less than that observed in the samples in which emulsions which had a lower silver bromide content but which did not contain a local silver bromide phase had been used, but the change was large when compared to that observed with samples in which a silver halide emulsion which had a local phases had been used. Moreover, when the emulsions which had a silver bromide content of 40 mol % were used, magenta and cyan colorations appeared at high exposure in the regions which had been exposed to blue light and which should have had a yellow coloration, and the results obtained were undesirable from the point of view of color reproduction. It is known that this phenomenon becomes more pronounced as the silver bromide content is increased.

It is clear from the results described above that the density difference between the parts where the scanning exposure starts and finishes which arises because of the discrepancy in the time of the scanning exposure which arises with the conventional technique can be ameliorated by increasing the silver bromide content but this inevitably leads to a worsening of color reproduction characteristics. Thus, there is a dilemma here in that if the color reproduction characteristics are improved then the difference in density between the parts where the scanning exposure starts and finishes increases.

It is clear that both these problems can be overcome at the same time by introducing a local silver bromide phase into the silver halide emulsion grain surface and reducing the total silver bromide content.

EXAMPLE 3

Test were carried out in the same way with the coated Samples i to vi used in Example 2 using the development processing operations and processing baths indicated below.

The results obtained were such as to demonstrate the remarkable effect on this invention in the same way as in Example 2.

| Processing Operation | Temperature | Processing Time |
|---|---|---|
| Color development | 35° C. | 45 seconds |
| Bleach-fix | 30–36° C. | 45 seconds |
| Stabilization (1) | 30–37° C. | 20 seconds |
| Stabilization (2) | 30–37° C. | 20 seconds |
| Stabilization (3) | 30–37° C. | 20 seconds |
| Stabilization (4) | 30–37° C. | 30 seconds |
| Drying | 70–85° C. | 60 seconds |

(Four tank counter-flow system from stabilization (1) to stabilization (4)

| | Parent Bath |
|---|---|
| Color Development Bath | |
| Water | 800 ml |
| Ethylenediamine-tetraacetic acid | 2.0 g |
| Triethanolamine | 8.0 g |
| Sodium chloride | 1.4 g |
| Potassium carbonate | 25.0 g |
| N-Ethyl-N-(β-methanesulfonamidoethyl)-3-methyl-4-aminoaniline sulfate | 5.0 g |
| N,N-Diethylhydroxylamine | 4.2 g |
| 5,6-Dihydroxybenzene-1,2,4-trisulfonic acid | 0.3 g |
| Fluorescent whitener (4,4'-diamino stilbene based) | 2.0 g |
| Water to make up to | 1000 ml |
| pH | 10.10 |
| Bleach-fix Bath | |
| Water | 400 ml |
| Ammonium thiosulfate (70%) | 100 ml |
| Sodium sulfite | 18 g |
| Ethylenediamine tetraacetic acid, ferric ammonium salt | 55 g |
| Ethylenediamine tetraacetic acid, di-sodium salt | 3 g |
| Glacial acetic acid | 8 g |
| Water to make up to | 1000 ml |
| pH (25° C.) | 5.5 |
| Stabilizer Bath | |
| Formalin (37%) | 0.1 g |
| Formalin/sulfurous acid adduct | 0.7 g |
| 5-Chloro-2-methyl-4-isothiazolin-3-one | 0.02 g |
| 2-Methyl-4-isothiazolin-3-one | 0.01 g |
| Copper sulfate | 0.005 g |
| Water to make up to | 1000 ml |

-continued

| | |
|---|---|
| pH | 4.0 |

While the invention has been described in detail and with reference to specific embodiments thereof, it will be apparent to one skilled in the art that various changes and modifications can be made therein without departing from the spirit and scope thereof.

What is claimed is:

1. A method of forming a colored image by exposing and then developing a silver halide color photographic photosensitive material which has a blue sensitive silver halide emulsion layer, a green sensitive silver halide emulsion layer and a red sensitive silver halide emulsion layer on a support, comprising:

producing a silver halide color photographic material which includes in at least one of the green sensitive and red sensitive silver halide emulsion layers, silver halide grains which have a silver bromide phase wherein the silver bromide content is from about 30 to about 50 mol % localized at the surface and wherein the localized silver bromide phase is doped with metal ions selected from the group consisting of Ir, Fe, Rh, Pd, Pt and Ni and in which from 95 to 99.5 mol % (average value) of the grains as a whole in the emulsion layer consists of silver chloride, the remainder consisting of substantially silver iodide free silver bromide, and subjecting the material to a scanning exposure with blue light, green light and red light.

2. A method of forming a colored image as claimed in claim 1, wherein the localized silver bromide phase is present in a discontinuous isolated form at the surface of the silver halide grains.

3. A method of forming a colored image as claimed in claim 1, wherein the localized silver bromide phase is doped with iridium ions.

4. A method of forming a colored image as claimed in claim 1, wherein a scanning exposure is made using the second harmonics of a semiconductor laser.

5. A method of forming a colored image as claimed in claim 1, wherein the silver halide grains present in at least one of the green sensitive silver halide emulsion and red sensitive silver halide emulsion layers are silver halide grains in which there is a silver bromide containing layer at the corners of the grain surface, in which from 95 to 99.5 mol % of all the grains in said emulsion layer consist of silver chloride with a silver bromide content of from 0.5 to 5 mol %, and in which said metal ions selected from the group consisting of Ir, Fe, Rh, Pd, Pt and Ni are present.

6. A method of forming a colored image as claimed in claim 1, in which a laser is used as the scanning light source.

7. A method of forming a colored image as claimed in claim 1, wherein the scanning exposure is performed with a scanning light source which produces second harmonics which are obtained using a semiconductor laser and a second harmonic conversion element.

8. A method of forming a colored image as claimed in claim 7, wherein the second harmonic conversion element is an organic non-linear optical material.

9. A method of forming a colored image as claimed in claim 8, wherein the organic non-linear optical material is at least one compound which is represented by the general formulae (VII) or (VIII)

General Formula (VII)

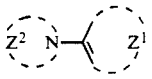

wherein $Z^1$ represents a group of atoms which is required to form a five or six membered aromatic ring which has at least one nitro group as a substituent group, $Z^2$ represents a group of atoms which is required to form a pyrrole ring, an imidazole ring, a pyrazole ring, a triazole ring or a tetrazole ring which may have substituent groups and condensed rings;

General Formula (VIII)

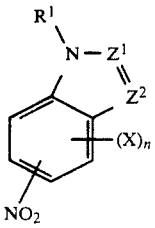

wherein $Z^1$ and $Z^2$ may be the same or different, each represents a nitrogen atom or a $CR^2$ group;

X represents an alkyl group, an aryl group, a halogen atom, an alkoxy group, an aryloxy group, an acylamino group, a carbamoyl group, a sulfamoyl group, an acyloxy group, an alkoxycarbonyl group, an aryloxycarbonyl group, an alkoxysulfonyl group, an aryloxysulfonyl group, an alkylthio group, an arylthio group, a hydroxyl group, a thio group, a carboxyl group, a ureido group, a cyano group, an alkylsulfonyl group, an arylsulfonyl group, an alkylsulfinyl group, an arylsulfinyl group or a nitro group;

n represents 0 or an integer of a value from 1 to 3;

$R^1$ represents a hydrogen atom, an alkyl group, an aryl group or an acyl group and $R^2$ represents a hydrogen atom, an alkyl group or an aryl group.

10. A method of forming a colored image as claimed in claim 7, wherein the wavelength conversion element has a guide structure.

11. A method of forming a colored image as claimed in claim 7, wherein the wavelength conversion element has a fiber type structure.

* * * * *